US007714489B2

(12) United States Patent
Torii et al.

(10) Patent No.: US 7,714,489 B2
(45) Date of Patent: May 11, 2010

(54) SPARK PLUG INCLUDING GROUND ELECTRODE WITH ARCUATELY CURVED FACE

(75) Inventors: Kazuyoshi Torii, Chita-gun (JP); Kazumasa Yoshida, Nagoya (JP); Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 709 days.

(21) Appl. No.: 11/545,490

(22) Filed: Oct. 11, 2006

(65) Prior Publication Data

US 2007/0080618 A1 Apr. 12, 2007

(30) Foreign Application Priority Data

Oct. 11, 2005 (JP) ..... 2005-297048
Oct. 11, 2005 (JP) ..... P2005-297046
Oct. 11, 2005 (JP) ..... P2005-297047

(51) Int. Cl.
*F02M 57/06* (2006.01)
*H01T 13/20* (2006.01)

(52) U.S. Cl. ..... 313/141; 313/118

(58) Field of Classification Search ..... None
See application file for complete search history.

(56) References Cited

U.S. PATENT DOCUMENTS 5,828,161 A 10/1998 Palyu
6,227,164 B1 5/2001 Miller
6,731,052 B2 5/2004 Moriya
6,831,397 B2 12/2004 Kanao et al.
2002/0121849 A1 * 9/2002 Kanao et al. ..... 313/141
2005/0077807 A1 4/2005 Suzuki et al.

FOREIGN PATENT DOCUMENTS

| | | |
|---|---|---|
| EP | 0 725 463 A1 | 8/1996 |
| EP | 0 895 327 A1 | 2/1999 |
| EP | 1 416 599 A2 | 5/2004 |
| EP | 1 531 530 A2 | 5/2005 |
| EP | 1 686 666 A1 | 8/2006 |
| FR | 2 820 893 | 8/2002 |
| JP | 52-48742 | 4/1977 |
| JP | 52-61650 | 5/1977 |

(Continued)

*Primary Examiner*—Toan Ton
*Assistant Examiner*—Britt D Hanley
(74) *Attorney, Agent, or Firm*—Sughrue Mion, PLLC

(57) ABSTRACT

A spark plug comprising: a center electrode extending in a direction of an axis of said spark plug; a cylindrical insulator which has a shaft hole, and which holds said center electrode in said shaft hole in a state where a tip end of said center electrode is projected from a tip end face of said insulator; a metal shell which holds said insulator; and a ground electrode in which one end is joined to a tip end face of said metal shell, and which extends from said one end toward another end, wherein said ground electrode has an inner side face which faces said center electrode, and an outer side face which is a back face with respect to said inner side face, said outer side face is formed as an arcuately curved face when viewed from a side of said another end in an extending direction of said ground electrode, and a columnar noble metal tip is joined to said inner side face.

11 Claims, 12 Drawing Sheets

FOREIGN PATENT DOCUMENTS

| | | |
|---|---|---|
| JP | 54-150525 | 11/1979 |
| JP | 8-339880 | 12/1996 |
| JP | 11-121142 | 4/1999 |
| JP | 2000-27653 | 1/2000 |
| JP | 2001-176638 | 6/2001 |
| JP | 2002-313524 | 10/2002 |
| JP | 2003-7423 | 1/2003 |
| WO | WO 2005/050803 A1 | 6/2005 |

* cited by examiner

SPARK PLUG INCLUDING GROUND ELECTRODE WITH ARCUATELY CURVED FACE

FIELD OF THE INVENTION

The present invention relates to a spark plug which is to be mounted on and used in an internal combustion engine, and more particularly to a spark plug which realizes an excellent flame developing property.

BACKGROUND OF THE INVENTION

A spark plug is used as an ignition device which performs a spark discharge while using a gap between a center electrode and a ground electrode that are exposed in a combustion chamber of an internal combustion engine, as a spark discharge gap. Conventionally, in order to realize a prolonged lifetime of a spark plug, a tip of a noble metal alloy (hereinafter, also referred to merely as noble metal tip) which is excellent in spark wear resistance and resistance to oxidation at high temperatures (hereinafter, the spark wear resistance and the resistance to oxidation at high temperatures are often referred in combination as durability) is joined to a tip end portion(s) of one or both of the electrodes which will function as the starting point of a spark discharge (for example, see JP-A-8-339880). When a noble metal tip which is excellent in durability is used, it is possible to reduce the diameter of the noble metal tip which will function as the starting point of a spark discharge. Therefore, a configuration where the lifetime can be prolonged, and, when the tip is made very thin, spread of flame (hereinafter, also referred to merely as flame developing property) which is an ignited air-fuel mixture is not impeded can be realized (for example, see JP-A-2002-313524).

Before a very thin noble metal tip is used as means for improving the flame developing property, various improvements have been made because of the following reason. A spark plug is used while a male thread formed on a metal shell is fastened to a female thread formed in an internal combustion engine. In the mounting process, it is very difficult to mount a spark plug in consideration of the direction of the ground electrode. When an air-fuel mixture proceeds from the periphery of the spark plug to a place where a spark discharge occurs, and when the air-fuel mixture is ignited and then a flame develops, the movement of the air-fuel mixture or the development of the flame is blocked by the presence of the ground electrode, and hence there arises a problem in that the combustion efficiency is lowered.

In order to solve such a problem, a configuration which is disclosed in, for example, JP-A-11-121142, and in which a ground electrode has a circular section shape (hereinafter, such a ground electrode is referred to merely as round ground electrode) has been proposed. When this configuration is employed, a phenomenon that a flow of an air-fuel mixture is blocked by the ground electrode and a gas flow is separated from the ground electrode can be prevented from occurring, or another phenomenon that a flame in a growth process is contacted with the ground electrode, and hence heat is drawn from the flame, thereby impairing the development of the flame can be prevented from occurring.

SUMMARY OF THE INVENTION

In the field of an automobile in which a spark plug is used, miniaturization and efficiency increase of an engine have been advanced. For example, the diameters of intake/exhaust ports are increased, and an injector is placed in the vicinity of a combustion chamber as a result of direct injection of fuel. Therefore, it is requested to reduce the diameter of a spark plug. In order to meet the request, the thread diameter of a spark plug is reduced to, for example, M12 or smaller. However, an insulator which holds a center electrode must have a thickness which is sufficient for, when a high voltage for generating a spark discharge, preventing penetration breakage from occurring, and a predetermined gap is formed in order to prevent a spark discharge between the insulator and the metal shell, i.e., a so-called side spark from occurring. In consideration of these structures, the tip end face of the metal shell to which the ground electrode is to be joined is allowed only to have a very limited thickness.

A configuration where such a small-diameter metal shell is used to reduce the diameter of a spark plug, and a very thin noble metal tip is joined to a round ground electrode so as to provide a prolonged lifetime and an excellent flame developing property will be considered. As described above, however, it is not easy to sufficiently ensure the thickness of the tip end face of the metal shell to which the ground electrode is to be joined. In the case of a prismatic ground electrode which has been conventionally used, and which is substantially rectangular, the ground electrode can be joined to the tip end face of the metal shell while forming a width which is larger than the thickness the tip end face of the metal shell, and hence it is possible to avoid the possibility that the heat dissipation property of the ground electrode (heat conductance from the ground electrode to the metal shell) is insufficient. In the case of a round ground electrode, however, the electrode has a circular section shape, and hence its diameter is allowed only to have a value corresponding to the thickness of the tip end face of the metal shell, with result that it is difficult to ensure a sufficient heat dissipation property. It may be contemplated that a round ground electrode is configured by using a metal having an excellent thermal conductivity, such as Cu as a core member. According to this configuration, however, the number of production man-hours is inevitably increased. If these problems are solved and a very thin noble metal tip is joined, it is possible to realize a spark plug which is excellent in lifetime and flame developing property.

A configuration where a very thin noble metal tip is used in order to prolong the lifetime and improve the ignitability, and the noble metal tip is joined to a round ground electrode so as to realize a further excellent flame developing property will be considered. Since the outline of a round ground electrode is arcuately bent, it is not easy to firmly join a noble metal tip which is formed into a substantially columnar shape having a flat face at the upper and lower ends, to the electrode. For the purpose of improving the joining property between the noble metal tip and the round ground electrode, the joining face of the noble metal tip may be previously processed to form a recess or an arcuate portion so as to enable the joining face to be engaged with the round ground electrode. However, there is a problem in that this configuration is not practical because of increases of the production cost and man-hours, and difficulty in facing of the noble metal tip.

Since the noble metal tip is formed into a columnar shape having a flat face at the upper and lower ends, it is not easy to realize firm joining with the round ground electrode having the arcuate face. The case where the joining process is conducted by, for example, resistance welding will be considered. In the lower face (the end face on the side to be joined to the ground electrode) of the columnar tip, only a portion which is near the center is contacted with the ground electrode. Therefore, a current does not flow through a portion which is remote from the center, with the result that welding is performed in so-called "floating state" in which only the portion in the vicinity of the center is joined to the ground electrode. By contrast, the case where the joining process is conducted by laser welding will be considered. In contrast to the lower face of the noble metal tip which is a flat face, the side face of the round ground electrode has a predetermined radius curvature. Therefore, only a portion of the noble metal tip which is near the center is contacted with the side face of the ground electrode, and a portion which is remote from the center is separated also from the side face. As a result, even when irradiation with a laser beam is conducted, the degree of penetration between the round ground electrode and the noble metal tip is low. Also in this case, consequently, firm joining is hardly realized.

The invention has been conducted under the above-discussed various circumstances. It is an object of the invention to provide a small-diameter spark plug in which a noble metal tip is firmly joined to a round ground electrode to enhance the reliability, which comprises a ground electrode that has a flame developing property equivalent to that of the round ground electrode, that is enabled to have a prolonged lifetime, and that has an excellent heat dissipation property. It is another object of the invention to provide a method which enables the production of such a spark plug to be performed without unnecessarily increasing the production cost and the man-hours.

In order to solve the problems, a spark plug of a first configuration of the invention is a spark plug comprising:

a center electrode (which may be a rod-like shape) extending in a direction of an axis of the plug;

a cylindrical insulator which has a shaft hole, and which holds the center electrode in the shaft hole in a state where a tip end of the center electrode is projected from a tip end face of the insulator;

a metal shell which holds the insulator; and a ground electrode in which one end is joined to a tip end face of the metal shell, and which extends from the one end toward another end, wherein the ground electrode has an inner side face which faces the center electrode, and an outer side face which is a back face with respect to the inner side face, the outer side face is formed as an arcuately curved face when viewed from a side of the another end in an extending direction of the ground electrode, and a columnar noble metal tip is joined to the inner side face.

According to the configuration, in the case where the spark plug is mounted on an internal combustion engine, even when the ground electrode is not ideally directed, the combustion efficiency can be maximized. In the case where a spark plug is configured by using a conventional round ground electrode, as compared with a configuration where a rectangular columnar ground electrode is used, an air-fuel mixture more easily enters a spark discharge gap, and therefore it can be the that the combustion efficiency is improved. It has been checked that the combustion efficiency is further improved in the configuration of the invention. Although the reason is not clear, this is caused by the following phenomenon. Since the noble metal tip which protrudes from the ground electrode toward the center electrode exists, the distance from the ground electrode to a middle portion of the spark discharge gap is prolonged, and the air resistance (including resistances due to the air-fuel mixture and the combustion gas) and their flows (swirl and tumble flows, and the like) in the combustion chamber exert influences during a period when the air-fuel mixture reaches the middle portion of the spark discharge gap, thereby eliminating a phenomenon that a Karman vortex caused by the ground electrode impedes the flow of the air-fuel mixture. Moreover, also the following phenomenon affects the improvement. An ignited air-fuel mixture, i.e., a combustion gas spreads over the periphery of the noble metal tip which has a smaller volume, when its flame kernel is small. After the flame kernel sufficiently grows, the combustion gas spreads over the periphery of the ground electrode which is larger in volume than the noble metal tip. Therefore, the growth of the flame kernel immediately after ignition is hardly impeded.

In order to further improve the combustion efficiency, preferably, a direction in which the noble metal tip protrudes from a portion that is joined to the ground electrode is set as a tip axis, and a protrusion length h in the direction of the tip axis is larger than a width d in a direction which is perpendicular to the direction of the tip axis. In a noble metal tip having a so-called vertically elongated shape (h>d), the size of h is desired to be 16% or more of the external dimension of the round ground electrode.

As described above, it is not easy to join a columnar noble metal tip to a round ground electrode to obtain sufficient joining strength. As a third configuration of the invention, therefore, it is preferable to form a configuration where, when the ground electrode is viewed from the side of the another end in the extending direction of the ground electrode, the ground electrode has:

a flat face which is in the inner side face, and in which an outline of the ground electrode is formed as a linear portion; and two first arcuate portions which begin at end portions of the linear portion, and which are positioned on sides of ends of the linear portion, respectively, and the tip end face of the noble metal tip protrudes more than an intersection of two virtual extended arcs on a side of the inner side face, the virtual extended arcs having a radius curvature R which is equal to radius curvatures of the first arcuate portions, and being formed be extending the first arcuate portions.

Usually, a noble metal tip is produced by drawing an ingot of a noble metal to form a very thin wire, and conducting a step of cutting the wire to be formed into a columnar shape having a flat face at the upper and lower ends. In order to join a noble metal tip to a round ground electrode to obtain firm joining strength, with respect to the flat face of the noble metal tip, a flat face is disposed on the side of the round ground electrode to which the noble metal tip is to be joined, and which faces the center electrode.

However, simple disposition of such a flat face fails to always attain the effect. When an excessively large flat face is formed, there is a possibility that the effect of the round ground electrode, i.e., an excellent flame developing property cannot be attained. In order to effectively obtain the effect of the round ground electrode, a configuration may be formed in which virtual extended arcs are formed by virtually extending two first arcuate portions that are continuous to the both ends of the linear portion constituting the flat face, toward the center electrode, and the tip end face of the noble metal tip which is close to the center electrode protrudes more than an intersection of the virtual extended arcs. According to the configuration, flame which is ignited between the tip end face of the noble metal tip and that of the center electrode is not contacted with the flat face of the ground electrode until the flame develops to some extent, and hence high ignitability can be realized. Thereafter, the flame spreads along the side face of the ground electrode which is formed into an arcuate shape, and hence it is possible to obtain also a high flame developing property. Preferably, the flat face to which the noble metal tip is to be joined has an area which is equal to or larger than a butting face of the noble metal tip, so as to obtain more firm joining strength.

As a fourth configuration of the invention, preferably, when the ground electrode is viewed from the side of the another end in the extending direction of the ground electrode, in one of the two first arcuate portions, a center of an arc forming the one first arcuate portion (a center of a circle including the one first arcuate portion) is on a centerline dividing the linear portion or on a side of another one of the two first arcuate portions with respect to the centerline (is on a side of another one of the two first arcuate portions, the side including a centerline dividing the linear portion). The centerline means a line which is drawn in a radial direction of the plug axis to divide the linear portion when the ground electrode is viewed after the ground electrode is unbent linearly as shown in FIGS. 2 to 5. When the first to third configurations are employed, the ignitability, the flame developing property, and the lifetime can be respectively improved. From the viewpoint of improvement of the flame developing property, particularly, the fourth configuration may be employed.

When the first arcuate portions have a fixed radius curvature, particularly, it is preferable to, as a fifth configuration of the invention, employ a configuration where, when the ground electrode is viewed from the side of the another end in the extending direction of the ground electrode, the ground electrode has: a flat face which is in the inner side face, and in which an outline of the ground electrode is formed as a linear portion; and two first arcuate portions which begin at end portions of the linear portion, and which are positioned on sides of ends of the linear portion, respectively, and the flat face is positioned between a midpoint of (h+1) and the tip end face of the noble metal tip, (h+1) being defined by: a protrusion length h by which, when a direction in which the noble metal tip protrudes from a portion that is joined to the ground electrode is set as a tip axis, the noble metal tip protrudes in the direction of the tip axis; and a thickness l of the ground electrode in a radial direction of the plug axis.

When paying attention to the noble metal tip, it is preferable to, as a sixth configuration of the invention, employ a configuration where a spark discharge gap G which is formed by the tip end of the center electrode and the noble metal tip joined to the ground electrode, and a gap H which is a minimum gap between the tip end of the center electrode and the ground electrode satisfy a relationship of $0.5\ \text{mm} \leqq H-G \leqq 1.0\ \text{mm}$.

A ground electrode which is employed in a usual spark plug has a substantially rectangular columnar shape. Therefore, a spark discharge is often conducted in a place where the spark discharge gap is narrowest, or at an edge where the electric field is steep. By contrast, as compared with a substantially rectangular ground electrode, a ground electrode having an arcuate portion as in the invention has a reduced number of portions where the electric field is steep, and hence a spark discharge sometimes occurs on a side which is approximately opposite to the center electrode while proceeding around the round ground electrode. By contrast, a molten portion between the noble metal tip and the base material of the round ground electrode has a low work function, and hence a discharge easily occurs in the portion. Therefore, a spark discharge sometimes occurs in the portion. When the latter spark discharge repeatedly occurs, particularly, the portion to which the noble metal tip is joined is consumed to be decreased, and there is a possibility that the joining strength is lowered.

When the above sixth configuration is employed for such a problem, it is possible to maintain a spark plug in which the frequencies of the spreading of a spark discharge around the ground electrode, and a discharge to a molten portion are lowered, and which is excellent in ignitability and flame developing property for a long term.

Now, attention is paid particularly to the improvement of the heat dissipation property of the ground electrode. A seventh configuration of the invention may be employed where, when the ground electrode is viewed from the side of the another end in the extending direction of the ground electrode, the ground electrode is formed by: a flat face which is in the inner side face, and in which an outline of the ground electrode is formed as a linear portion; two first arcuate portions which have a radius curvature r, and which begin at end portions of the linear portion, which extend toward other ends of the first arcuate portions, and which are positioned on sides of ends of the linear portion; and a second arcuate portion through which the other ends of the first arcuate portions are coupled together, and which has a radius curvature R.

As in the seventh configuration, the shape as viewed from the side of the another end in the extending direction of the ground electrode, i.e., the outline of a section of the ground electrode is formed into a substantially semicircular shape by connecting the both ends of the linear portion with the arcuate portions (first arcuate portions) having a radius curvature which is relatively small, and end points of the arcuate portions through the arcuate portion (second arcuate portion) having a radius curvature which is relatively large, whereby the ground electrode is enabled to be joined to the tip end face of the metal shell through a joining area which is relatively larger as compared with the case of a round ground electrode (however, the both ends of the linear portion of the substantially semicircular shape are configured by the first arcuate portions, and have a form which is R-chamfered). Therefore, it is possible to avoid the phenomenon that the heat dissipation property of the ground electrode is insufficient, and the ground electrode can be provided with an excellent heat dissipation property which is a property of a round ground electrode. When this configuration is provided and the first and second arcuate portions having different radius curvatures are formed, it is possible to prevent the phenomenon that a gas flow such as an air-fuel mixture is separated from the ground electrode and the combustion efficiency is lowered, from occurring. In a more preferable mode, the length of the linear portion is larger than the thickness of the tip end face of the metal shell, and joining is performed so that the linear portion does not protrude from the tip end face of the metal shell. An eighth configuration of the invention is a more specific configuration of the more preferable mode.

In the eighth configuration of the invention, the radius curvature r of the first arcuate portions, and the radius curvature R of the second arcuate portion satisfy a relationship of $r<R$. As described above, when the ground electrode is joined so that the flat face (which is seen as a linear form when viewed in the extending direction) faces the center electrode, and the radius curvatures r, R satisfy the relationship of $r<R$, the joining area between the ground electrode and the metal shell can be obtained more efficiently. The noble metal tip is joined to a portion constituting the flat face, in the side face of the ground electrode. Therefore, the joining of the noble metal tip to the ground electrode can be made more stable.

It is preferable to set the radius curvature r of the first arcuate portions of the eighth configuration in the following manner. Namely, a ninth configuration is employed where, when a distance between two intersections at which a virtual arc formed by extending an outer peripheral edge of the second arcuate portion intersects with a virtual extension line of the linear portion is $D_1$, the radius curvature r of the first arcuate portions is $D_1/9 \leqq r \leqq D_1/5$.

When the radius curvature r of the first arcuate portions is set to be $D_1/9$ or larger, it is possible to prevent the phenomenon that a gas flow flowing from the outside of the spark plug to the center is separated from the ground electrode at inflection points where the second arcuate portion is transferred to the first arcuate portions and the combustion efficiency is lowered, from occurring. When the radius curvature r is suppressed to $D_1/5$ or smaller, a flat face which is sufficient for facilitating the joining of the noble metal tip can be ensured.

When paying attention to the noble metal tip, it is preferable to set an outer diameter d of the noble metal tip to 0.4 mm$\leqq$d$\leqq$0.8 mm, and the ground electrode satisfies a relationship of $D_1-2r \geqq 1.5d$ (tenth configuration). When the outer diameter d of the noble metal tip is smaller than 0.4 mm, it is difficult to realize a long lifetime even in the case where a noble metal which is excellent in spark wear resistance and resistance to oxidation at high temperatures is used. By contrast, when d is larger than 0.8 mm, the flame developing property is impeded, and this configuration is out of the spirit of the invention. In the case where such a noble metal tip is used, when $D_1-2r$, i.e., the length of the flat face of the ground electrode is equal to or larger than 1.5d, the noble metal tip can be joined to the ground electrode while the noble metal tip is provided with sufficient strength.

By contrast, from the viewpoint of the joining property between the ground electrode and the noble metal tip, it is preferable to employ the following eleventh configuration. In the configuration, when the ground electrode is viewed from the side of the another end in the extending direction of the ground electrode, the inner side face of the ground electrode is divided by two straight lines which pass through a portion of an outer peripheral face of the noble metal tip, the portion being closest to the ground electrode, and which are parallel to the tip axis, and, when a section of the divided inner side face which is between the two straight lines is set as a section A, and a section of the divided inner side face which excludes the section A is set as a section B, a radius curvature RA of an inner side face in the section A, and a radius curvature RB of an inner side face in the section B satisfy a relationship of RA$\geqq$RB.

As in the eleventh configuration, when, in the side face of the round ground electrode, the radius curvature RA of the inner side face of the portion to which the noble metal tip is to be joined (corresponding to the section A) is set to be equal to or larger than the radius curvature RB of the inner side face of the portion to which the noble metal tip is not to be joined (corresponding to the section B), the following effects can be expected. When the noble metal tip is pressed, the butting area of the near-center portion where the lower face of the noble metal tip and the side face of the round ground electrode are contacted with each other is increased. In resistance welding, for example, this causes the portion which melts in an initial stage of the resistance welding, to become larger than that in the conventional art. Therefore, the welding property is improved, and the defect that joining is performed in "floating state" can be reduced. Also when laser welding is conducted, the distance by which the side face of the round ground electrode is separated from the lower face of the noble metal tip can be shortened, and hence more stable joining is enabled. It is a matter of course that it is more preferable to set RA>RB while excluding RA=RB.

The risk of dropping off of the noble metal tip can be considered as follows.

Unlike a ground electrode which has a substantially rectangular section, and which is conventionally used, the round ground electrode does not have an edge in which concentration of an electric field easily occurs. In the periphery of the round ground electrode, consequently, there are few portions where the electric field gradient is steep. Originally, a spark discharge is performed between the tip end of the center electrode and the noble metal tip joined to the round ground electrode. Unlike a substantially rectangular ground electrode, however, there is no edge, and hence a spark discharge sometimes proceeds around the round ground electrode to occur on a side which is approximately opposite to the center electrode. The molten portion between the noble metal tip and the base material of the round ground electrode has a low work function, and hence a discharge easily occurs in the portion. Therefore, a spark discharge sometimes occurs in the portion. When the latter spark discharge repeatedly occurs, particularly, the portion to which the noble metal tip is joined is consumed to be decreased, and there is a possibility that the joining strength is lowered. The heat generated by combustion in an engine is not sufficiently dissipated from the noble metal tip. Consequently, even a possibility that the noble metal tip is peeled off from the ground electrode by vibration of the engine and drops off into the combustion chamber is caused.

In order to avoid the possibility, it is preferable to employ the following configuration which is a thirteenth configuration of the invention. In the configuration, a spark discharge gap G which is formed by the tip end of the center electrode and the noble metal tip joined to the ground electrode, and a gap H which is a minimum gap between the tip end of the center electrode and the ground electrode satisfy a relationship of 0.5 mm$\leqq$H−G$\leqq$1.0 mm.

When the thirteenth configuration of the invention is employed, the possibility that a spark discharge occurs on a side opposite to the center electrode, or that a spark discharge is performed on the molten portion between the round ground electrode and the noble metal tip can be reduced. In order to attain the effect more remarkably, preferably, the amount of the protrusion of the noble metal tip toward the center electrode with respect the joining face with the round ground electrode is equal to or longer than 0.5 mm and equal to or shorter than 1.0 mm.

A method of producing a spark plug having a configuration where a noble metal tip is joined to a round ground electrode may comprises: a resistance welding step of temporarily fixing the noble metal tip to the one side face of the ground electrode by resistance welding; and a step of, after the temporary fixation, applying laser welding on a whole periphery of a joining face between the noble metal tip and the ground electrode, thereby performing fixation. When a spark plug is produced in this manner, the noble metal tip having a flat lower face can be stably fixed to a very unstable portion, i.e., the side face of the round ground electrode.

Another production method is a method of producing a spark plug in which a columnar noble metal tip is laser welded to one side face of a columnar ground electrode, wherein the method comprises: means for positioning the noble metal tip with respect to the side face of the ground electrode; and means for performing welding while changing an irradiation angle or irradiating position of a laser beam in accordance with a positioning state of the noble metal tip. Even when the laser irradiation angle and the laser irradiating position are fixed, welding may be performed while changing the power in accordance with the positioning state.

When a spark plug is produced by the production method, the noble metal tip can be satisfactory joined to the columnar ground electrode. The means for positioning the noble metal tip with respect to the round ground electrode may be the temporary fixation by means of resistance welding, or may use a positioning jig. Namely, any means may be used as far as the position of the noble metal tip with respect to the round ground electrode remains unchanged until the welding is completed.

DETAILED DESCRIPTION OF THE INVENTION

Figure 1:
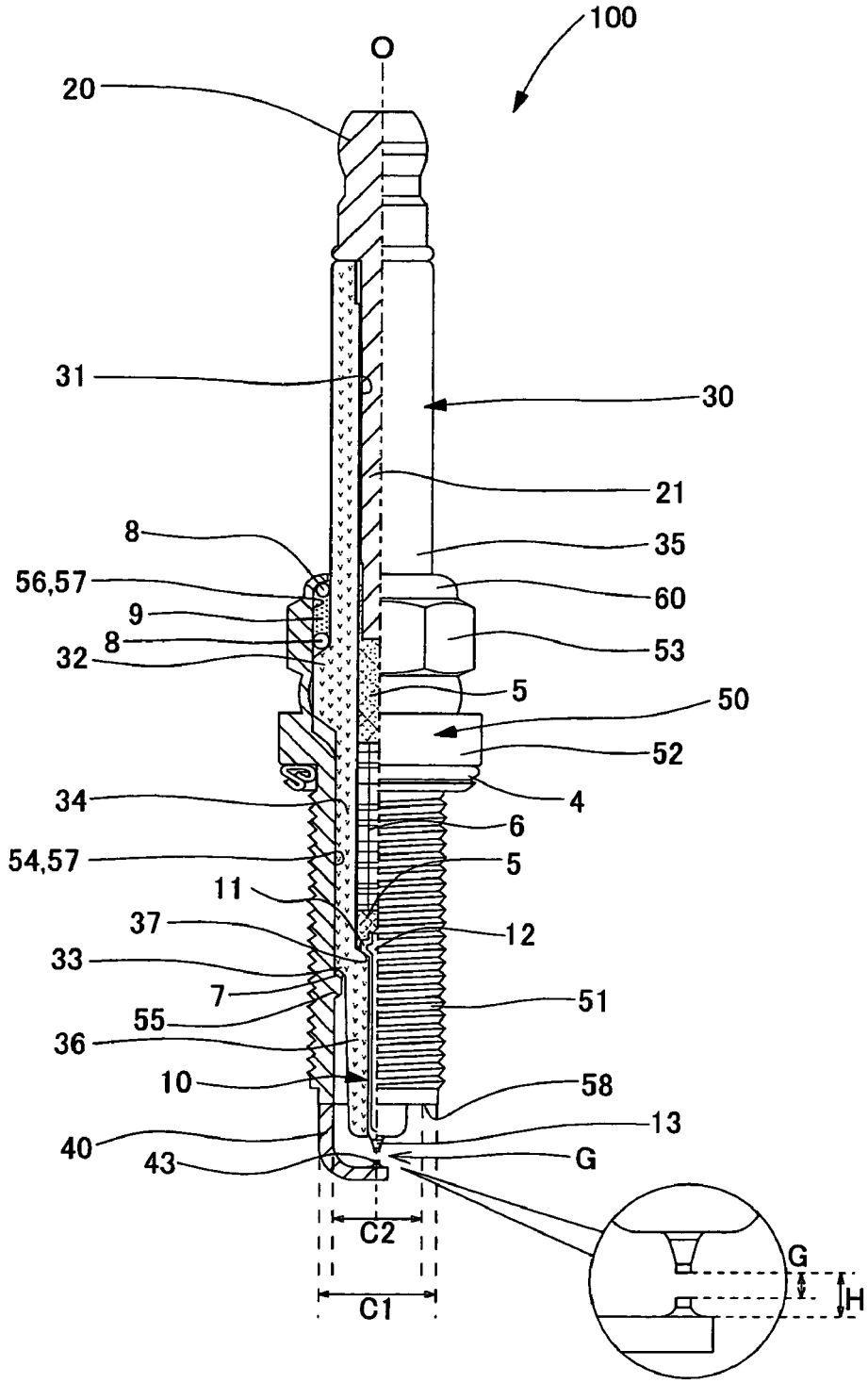
FIG. 1 is a partially sectional view showing the whole of a spark plug 100 of the invention.

Hereinafter, an embodiment of the invention will be described with reference to the accompanying drawings. FIG. 1 is a view showing the whole of the spark plug 100 of the invention. The spark plug 100 is generally configured by combining a center electrode 10, a terminal electrode 20, an insulator 30, a ground electrode 40, and a metal shell 50. The components will be described. FIG. 1 will be described while setting the lower side of the figure as a tip end side, and the upper side as a rear end side.

The center electrode 10 is formed into a substantially rod-like shape having a flange 11 in a rear end portion, with using a Ni-base alloy such as INCONEL 600 (registered trademark) as the base material. For the purpose of improving the thermal conductivity, a Cu alloy constitutes a core 12 in a center portion of the base material made of the Ni-base alloy. An inner tip 13 which is made of a noble metal alloy containing Pt, Ir, and the like, and which has a excellent durability is joined to the tip end of the center electrode 10. In the embodiment, the joining is performed by so-called laser welding in which laser beam irradiation and a pressing operation are conducted.

By contrast, the ground electrode 40 disposed on the metal shell 50 is configured by using a Ni-base alloy as the base material, formed into a rod-like shape, and joined to the tip end of the metal shell 50. The ground electrode 40 is bent at a substantially right angle so that one side face at the tip end cooperates with the inner tip 13 joined to the center electrode 10 to form a spark discharge gap G. For the purpose of improving the ignitability, the flame developing property, and the durability, an outer tip 43 made of a noble metal alloy in the same manner as the center electrode 10 is joined to one side face of the tip end portion of the ground electrode 40. The outer tip 43 corresponds to "noble metal tip" in the invention. The configuration of the ground electrode 40 which is the essential point of the invention will be described later in detail.

The metal shell 50 is first formed into a substantially cylindrical shape by applying a plastic working process on an iron-base metal member such as S15C or S25C, or a metal member such as stainless steel. After a finishing process such as cutting, an approximate shape of the metal shell is formed. A thread portion 51 for mounting the spark plug 100 on an internal combustion engine which is not shown is formed in the tip end side of the outer peripheral face of the metal shell 50. On the outer surface of the rear end side of the thread portion 51, formed is a flange 52 having a seating face which, when mounted on an internal combustion engine, hermetically seals the combustion chamber via a gasket 4. A tool engagement portion 53 which has, for example, a hexagonal section shape, and with which, when attached to an internal combustion engine, a tool such as a plug wrench is to be engaged is formed on the rear end side of the flange 52. In the metal shell, a portion between the tool engagement portion 53 and the flange 52 is formed as a thin portion so that the portion buckles when the insulator 30 is attached (FIG. 1 shows a state where the portion has buckled). In the embodiment, the opposite side distance of the tool engagement portion 53 is set as HEX14.

The rear end side of the tool engagement portion 53 is formed into a thin cylindrical portion so that a crimp cover 60 which is configured as a rearmost end portion of the metal shell 50 in completion of the spark plug 100 is formed. In an inner hole 57 of the metal shell 50, a small-diameter hole 54 is formed in the axial position where the thread portion 51 is formed, and a shelf 55 which protrudes in an inner radial direction is formed on the tip end side of the small-diameter hole 54. In the rear end side continuous to the small-diameter hole 54, a large-diameter hole 56 is formed so as to extend from the axial position where the flange 52 is formed, to the rear end. The ground electrode 40 is joined to the tip end of the thus formed metal shell 50. This joining is performed by the resistance welding. After a welding protrusion is removed away, a process of plating with zinc or the like is conducted on the metal shell 50 together with the ground electrode 40.

The insulator 30 is prepared in the following manner. A binder or the like is mixed with insulating ceramic powder such as alumina or aluminum nitride, and then a pressing process is performed on the mixture to form an approximate shape of the insulator. The approximate shape is ground by a grinding wheel, and then fired. The insulator 30 has a substantially cylindrical shape. A shaft hole 31 is formed in the insulator. A flange-like middle trunk portion 32 which protrudes radially outward is formed in a substantially middle of the outer surface in the direction of the axis O. A tip-end side trunk portion 34 having a step 33 directed to the tip end is formed on the tip end side of the middle trunk portion 32.

By contrast, a rear-end side trunk portion 35 having an approximately identical outer diameter is formed on the rear end side of the middle trunk portion 32. When the spark plug 100 is completed, a portion which is on the tip end side of the step 33 formed in the tip-end side trunk portion 34 constitutes a leg portion 36 which is to be exposed to the combustion gas. A support step 37 which supports the flange 11 of the center electrode 10 is formed on the rear end side of the leg portion 36. The inner diameter of the shaft hole 31 is formed so that the tip end side of the support step 37 is smaller in inner diameter than the rear end side. The axis O corresponds to "plug axis" in the invention.

The manner of combining the center electrode 10 and the terminal electrode 20 with the insulator 30 will be described. The center electrode 10 is inserted into the shaft hole 31 of the insulator 30 so that the tip end is downward directed. The flange 11 of the center electrode 10 is engaged with the support step 37 of the insulator 30. As well known, a glass seal material which is prepared by mixing a glass powder and a metal powder, and a resistance material which is prepared by changing the mixing ratio of the raw-material powders are filled into the shaft hole. The terminal electrode 20 is inserted into the rear end of the insulator 30 so that a leg portion 21 of the terminal electrode 20 which is formed into a shaft-like shape is buried by the glass seal material which is filled in the hole. The insulator 30 into which the terminal electrode 20 is inserted is loaded into a heating oven to heat the insulator to a predetermined temperature, and the terminal electrode 20 is pressed to be positioned at a predetermined position. Thereafter, the insulator 30 is unloaded from the heating oven. As a result, the glass seal material and the resistance material are hardened to be formed as glass seals 5, 5 and a resistor 6, respectively, and the center electrode 10 and the terminal electrode 20 are fixed together in a state they are electrically conductive to each other through the materials. Usually, this step is called the glass sealing step. During the glass sealing step, firing of a glaze layer which is to be formed on the outer surface of the rear-end side trunk portion 35 may be simultaneously conducted.

The components are configured as described above. The insulator 30 having the center electrode 10 and the terminal electrode 20, and the metal shell 50 having the ground electrode 40 form the crimp cover 60 by a well-known crimping step while using plate packing 7, wire packing 8, 8, talc 9, and the like in order to improve the hermetical sealing property, thereby completing the spark plug 100.

Figure 2:
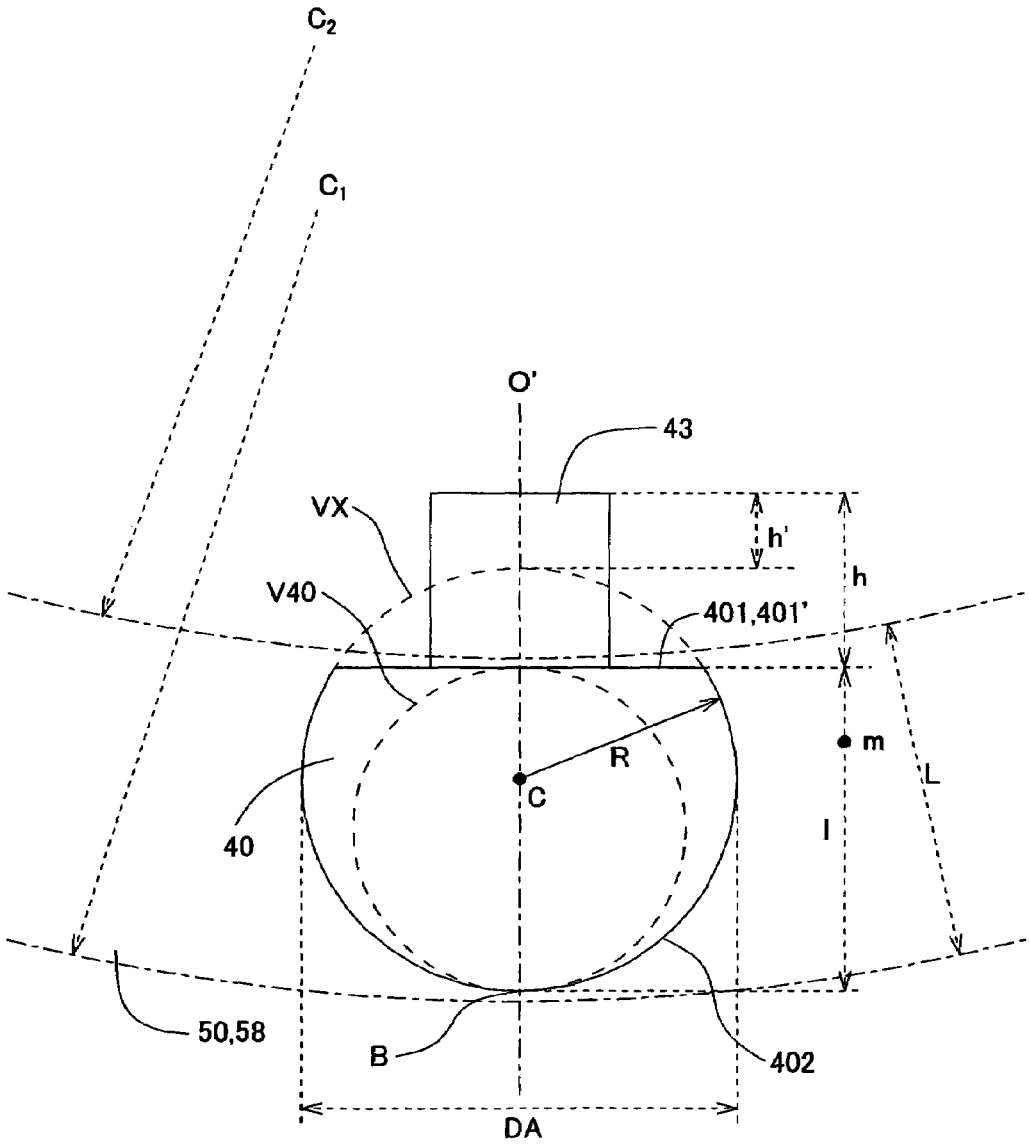
FIG. 2 is a diagram showing a first embodiment, as viewed from another end side in an extending direction of a ground electrode 40.

Hereinafter, the ground electrode 40 which is the essential point of the invention will be described in detail with reference to FIG. 2 showing a first embodiment. FIG. 2 shows a state where the ground electrode 40 is joined to the tip end face 58 of the metal shell 50. All of figures showing first to fifth embodiments and first and fifth comparative examples which will be described with reference to FIGS. 2 to 8 illustrate a state where the outer tip 43 has been welded to the ground electrode 40 but the ground electrode has not yet been bent.

As shown in FIG. 2, when viewed in the extending direction of the ground electrode 40 (corresponding to the front-and-back direction of the plane of the paper), the outline of the ground electrode is formed by: a flat face 401 formed as a linear portion 401' on the side of the center electrode 10 (the upper side of the drawing); and an arcuate portion 402 which draws an arc that is continuous to the both ends of the linear portion 401', and that has a radius curvature R. In the first embodiment, the arcuate portion 402 is an arc through which the both ends of the linear portion 401' are connected to each other, and which has a constant radius curvature. In other words, a shape which is obtained by cutting away the side face of the columnar ground electrode which is on the side of the center electrode 10 is formed. The linear portion 401' and the flat face 401 correspond to "inner side face" in the invention.

The distance (indicated by 1 in FIG. 2) between the linear portion 401' and the arcuate portion 402 which is positioned on the back (which corresponds to the radial outside of the spark plug, which is in the lower side of the drawing, and which is indicated by the reference letter B) corresponds to the thickness of the ground electrode 40. The longest one of line segments which are perpendicular (in the plane of the paper) to the thickness direction, and through which the outline of the ground electrode 40 is connected corresponds to the width DA of the ground electrode 40. The thickness l of the ground electrode 40 is determined in the following manner. The ground electrode 40 is joined to the tip end face 58 of the metal shell 50, and hence the thickness l is set so as not to exceed the thickness L of the tip end face 58 of the ground electrode 40. In the case of M12, for example, the outer and inner diameters $C_1$ and $C_2$ of the tip end portion of the metal shell 50 are about 10.1 mm and 7.3 mm, respectively. As described above, these values are determined in consideration of the thickness of the leg portion 36 of the insulator 30, and the gap between the inner diameter $C_2$ of the small-diameter hole 54 in the tip end portion of the metal shell 50, and leg portion 36. Therefore, one half of the diameter difference, i.e., $(C_1-C_2)/2$ is the maximum value of the thickness l of the ground electrode 40.

The ground electrode 40 is joined to the tip end face 58 of the metal shell 50. The heat which is received by the ground electrode 40 through the joining portion is transmitted to the metal shell 50. If it is assumed that the ground electrode 40 has a columnar shape of a substantially true circle, the width DA is equal to the thickness l and is about ϕ1.4 mm (in FIG. 2, indicated by the reference numeral V40 and the broken line). By contrast, in the first embodiment, because of the disposition of the flat face 401, the thickness l is 1.3 mm, and the width DA is 1.7 mm. According to the configuration, it is possible to increase the joining area with respect to the tip end face 58 of the metal shell 50, and the heat dissipation property of the ground electrode 40 can be improved.

The outer tip 43 is joined by laser welding to the ground electrode 40 which has the above-described shape. In the welding of the outer tip 43, the tip is joined to the flat face 401 of the ground electrode 40 which is formed on the side of the center electrode 10, thereby enabling the joining to be performed at satisfactory joining strength. The outer tip 43 has a length h of 0.8 mm, and is formed into a columnar shape of ϕ0.7 mm. When the spark plug 100 is completed, the length h of the outer tip 43 is handled as the protrusion length h of the noble metal tip. In the embodiment which is illustrated by the diagram, the lengths are synonymous with each other. Strictly speaking, a molten portion is produced in the welding process, and hence the protrusion length h of the noble metal tip is sometimes shorter than the length h of the noble metal tip.

An arc which is drawn by virtually extending toward the center electrode 10 at the same radius curvature R as the arcuate portion 402 which begin at the both ends of the linear portion 401' is indicated as a virtual extended arc VX. In FIG. 2 which shows the first embodiment, the radius curvature R of the arcuate portion 402 is uniform, and hence the shape formed by the arcuate portion 402 and the virtual extended arc VX is a substantially true circle. Since the outer tip 43 is joined while protruding toward the center electrode 10 more than the virtual extended arc VX, flame which is ignited by a spark discharge at a substantial middle between the outer tip 43 and the inner tip 13 can grow without being blocked by the flat face 401 of the ground electrode 40. As described above, the first configuration of the invention contains the concept of the length of the noble metal tip, and is configured so as to satisfy the relationship. For example, the amount h' of the protrusion from the intersection of the virtual extended arc is about 0.1 to 0.6 mm. In the first embodiment, the center of the arc of the arcuate portion 402 is on the centerline O' of the ground electrode 40. The center of the arc is indicated by the point C. The centerline O' corresponds to "center line which is drawn in a radial direction of the plug axis", when the ground electrode 40 is viewed after the ground electrode 40 is unbent linearly, in the invention.

Figure 3:
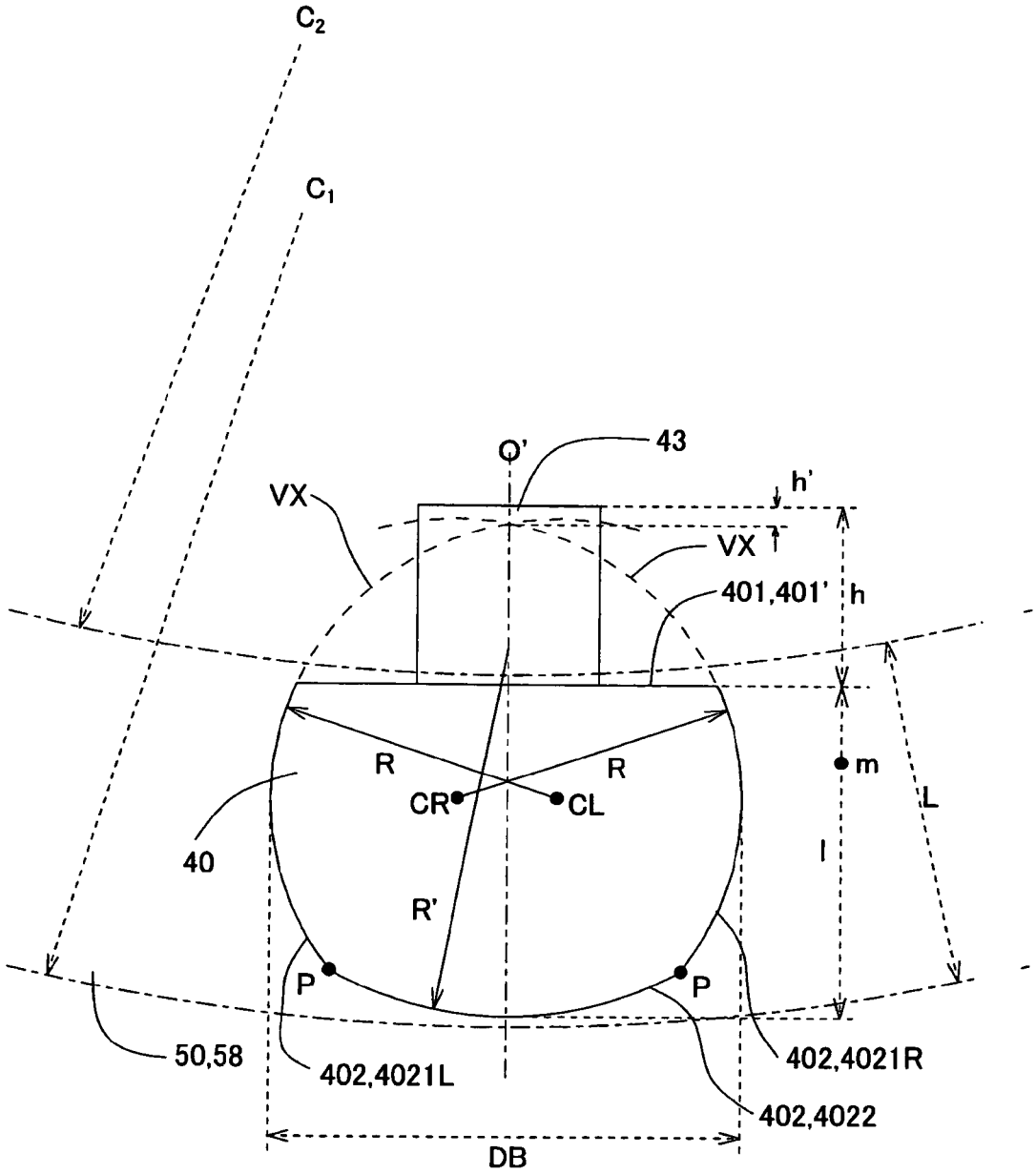
FIG. 3 is a diagram showing a second embodiment, as viewed from the another end side in the extending direction of the ground electrode 40.

The invention is not restricted to the first embodiment, and may be configured as the second embodiment shown in FIG. 3. The components which perform the identical function and effect will be described with using the same reference numerals.

Unlike the first embodiment, the second embodiment has a mode which is configured so that the portion corresponding to the arcuate portion 402 in the first embodiment is divided at inflection points P into first arcuate portions 4021R, 4021L and a second arcuate portion 4022. According to the configuration, even when the width DB of the ground electrode 40 is equal to the width DA in the first embodiment, the joining area between the tip end face 58 of the metal shell 50 and the ground electrode 40 can be increased, and the heat dissipation property of the ground electrode 40 can be improved. In order to more effectively attain the effect, it is preferable to make the radius curvature R' of the second arcuate portion 4022 larger than the radius curvature R of the first arcuate portions 4021R, 4021L. When the difference is excessively large, there arises a possibility that the gas flow (which means ignited flame, an uncombusted air-fuel mixture) is separated from the ground electrode 40 at the inflection points P. In order to suppress the separation of the gas flow, the difference between the radius curvatures may be limited to a certain degree, or the radius curvature in ranges beginning at middles of the first arcuate portions 4021R, 4021L may be gradually changed. The radius curvature of the first arcuate portions 4021R, 4021L may be set as that of the arc between the flat face 401 and the portion from which the width DB of the ground electrode 40 begins. When the radius curvature of the arc in the zone is not constant, the portion on the side of the flat portion 401 among the portions adjacent to the width DB may be deemed as the reference of the radius curvature.

Also in the second embodiment of FIG. 3, the tip end face of the outer tip 43 protrudes more than an intersection of the virtual extended arcs VX of the first arcuate portions 4021R, 4021L toward the center electrode 10, and hence the same effect as the first embodiment can be attained. The second embodiment shows an example in which the centers of the arcs of the first arcuate portions 4021R, 4021L are in the opposite sides of the respective arcs with respect to the center line O' of the ground electrode 40. The center of the first arcuate portion 4021R is indicated by CR, and that of the first arcuate portion 4021L by CL.

Figure 4:
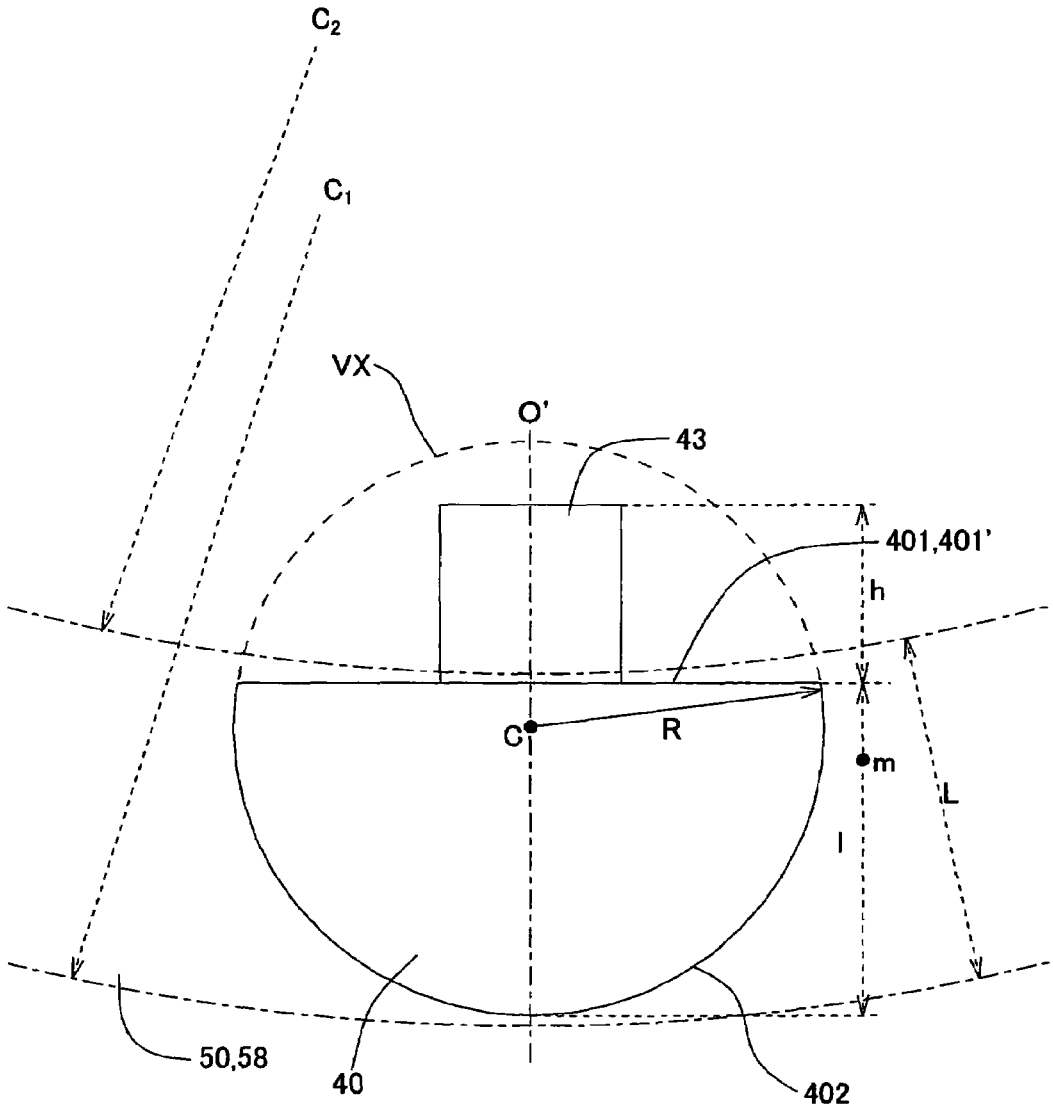
FIG. 4 is a diagram showing a first comparative example to be compared with the invention.

Next, a comparative example is shown in FIG. 4, and will be described as the first comparative example. In the same manner as the first and second embodiments, the components which perform the identical function and effect will be described with using the same reference numerals.

In the same manner as the first embodiment, the center C of radius curvature R of the arcuate portion 402 is on the center line O' of the ground electrode 40, but the tip end face of the outer tip 43 does not protrude more than the intersection of the virtual extended arc VX. According to the configuration, flame which is ignited at a substantial middle between the inner tip 13 and the outer tip 43 reaches the flat face 401 of the ground electrode 40 before the flame sufficiently grows, and spreading of the flame is impaired. In order to avoid this situation, preferably, a configuration in which, as shown in the first and second embodiments, the tip end face of the outer tip 43 protrudes more than the intersection of the virtual extended arc VX toward the center electrode 10 is employed.

Figure 5A:
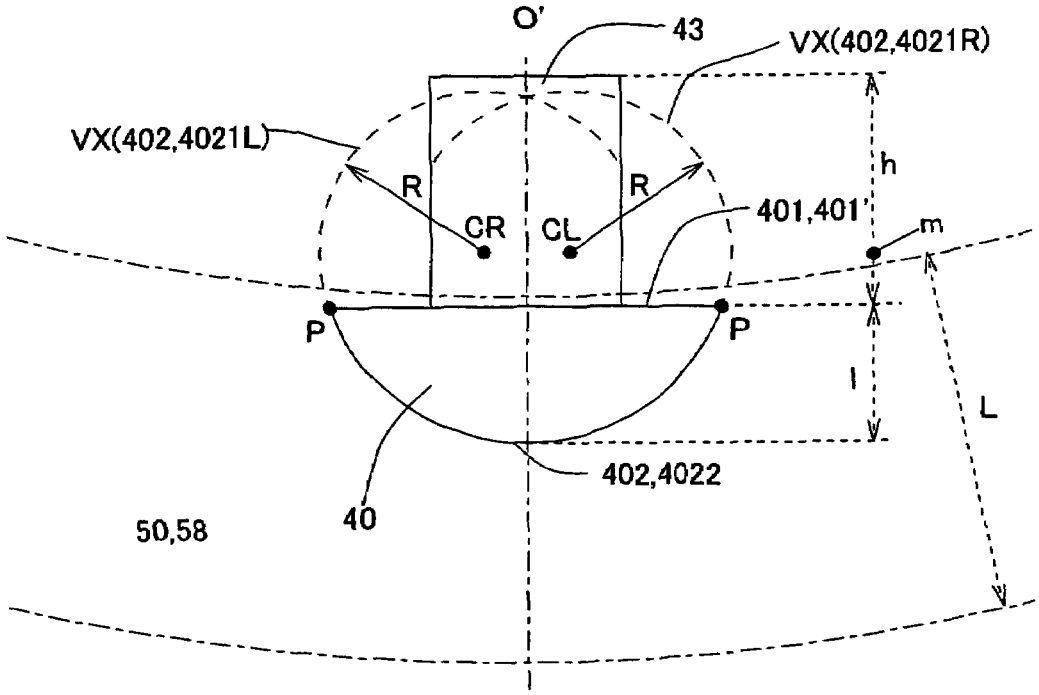
FIGS. 5A and 5B are diagrams showing a second comparative example to be compared with the invention.

For further comparison, the second comparative example shown in FIGS. 5A and 5B will be described. In the same manner as the first comparative example, the components which perform the identical function and effect will be described with using the same reference numerals. FIG. 5A shows a mode in which the size of the flat face 401 (linear portion 401') is made equal to that in the first embodiment, and FIG. 5B shows a mode in which the width DC of the ground electrode 40 is made equal to the width DA in the first embodiment.

In the same manner as the second embodiment, the second comparative example is configured so that the portion corresponding to the arcuate portion 402 is divided at the inflection points P into the first arcuate portions 4021R, 4021L and the second arcuate portion 4022 (in FIG. 5A, however, the inflection points P are positioned at the both ends of the linear portion 401', and hence the virtual extended arcs VX correspond to the first arcuate portions 4021R, 4021L). In the same manner as the second embodiment, the radius curvature of the second arcuate portion 4022 is larger than that of the first arcuate portions 4021R, 4021L which are closer to the linear portion 401' than the inflection points P. The radius curvatures of the first arcuate portions 4021R, 4021L in both FIGS. 5A and 5B are equal to each other, and are smaller than one half of the width DC of the ground electrode 40.

Figure 5B:
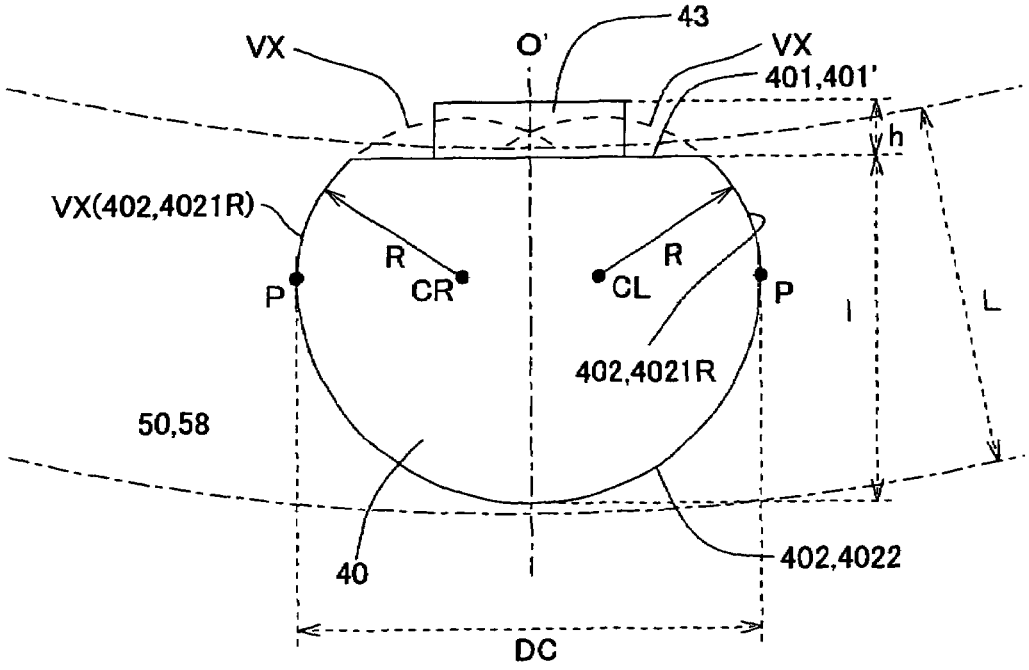

In both the examples of FIGS. 5A and 5B, in view of that the improvement effect on the gas flow is attained by forming the outline of the ground electrode 40 as an arc, the outline of the ground electrode 40 is formed so as not to form a portion which is recessed toward the inside of the ground electrode 40.

In the example of FIG. 5A, the tip end of the outer tip 43 is positioned on the side of the center electrode 10 with respect to the intersection of the virtual extended arcs VX, and hence there arises no problem of the flame developing property. However, there is a possibility that an air-fuel mixture flowing from the outside of the spark plug 100 is separated from the ground electrode at the inflection point P and the both ends of the linear portion 401', and hardly proceeds around to the spark discharge gap. Furthermore, the joining area of the ground electrode 40 to the tip end face 58 of the metal shell 50 is small, and hence the heat dissipation property is inferior as compare with the first and second embodiments.

In the example of FIG. 5B, the joining area with respect to the metal shell 50 is larger than that in the example of FIG. 5A, and hence there arises no problem of the heat dissipation property. Even when the outer tip 43 protrudes more than the intersection of the virtual extended arcs VX toward the center electrode 10, however, the absolute value of its length is shortened, and hence there arises a possibility that the flame developing property is impaired.

In the configuration which is common in FIGS. 5A and 5B of the second comparative example, the centers of the arcs of the first arcuate portions 4021R, 4021L are positioned on the respective arcuate portions with respect to the centerline (O') of the ground electrode 40. It seems that the problems arise because of the configuration. Therefore, it can be said that the centers of the arcs of the arcuate portions are preferably in the opposite sides of the respective arcs and including the centerline (O') of the ground electrode.

In both of the first and second embodiments, the flat face 401 is positioned between the midpoint m of h+1 and the tip end face of the noble metal tip 43. By contrast, in the second comparative example of FIG. 5A, the flat face 401 is not positioned between the midpoint m of h+1 and the tip end face of the noble metal tip. Because of this configuration, in the first and second embodiments, the joining area with respect to the tip end face 58 of the metal shell 50 can be sufficiently ensured. The first comparative example and the second comparative example of FIG. 5B have the fifth configuration, but fail to have the third configuration which is the presumption configuration, and hence the performance of the spark plug 100 cannot reach that of the first and second embodiments.

Next, the third embodiment shown in FIG. 6 will be described.

Figure 6:
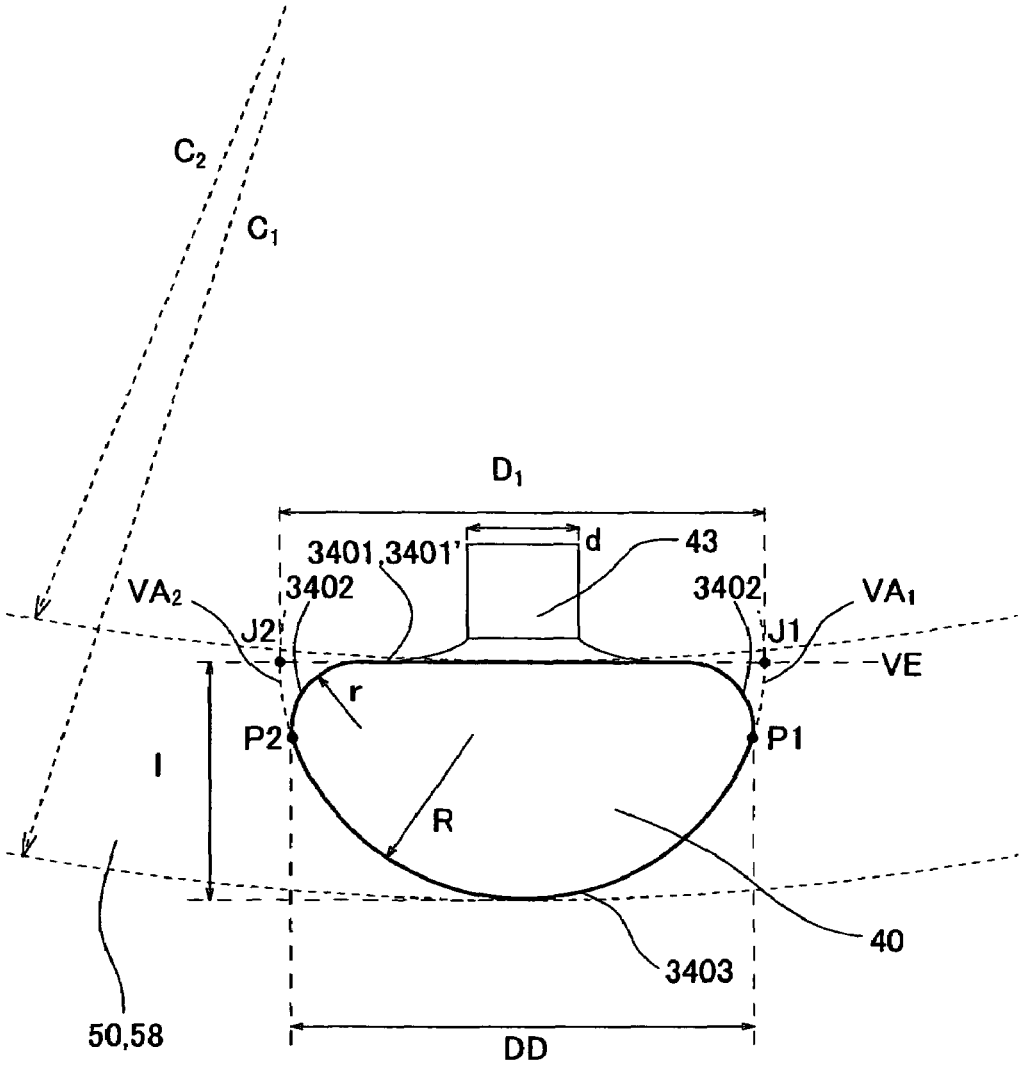
FIG. 6 is a diagram showing a third embodiment, as viewed from the another end side in the extending direction of the ground electrode 40.
Figure 7:
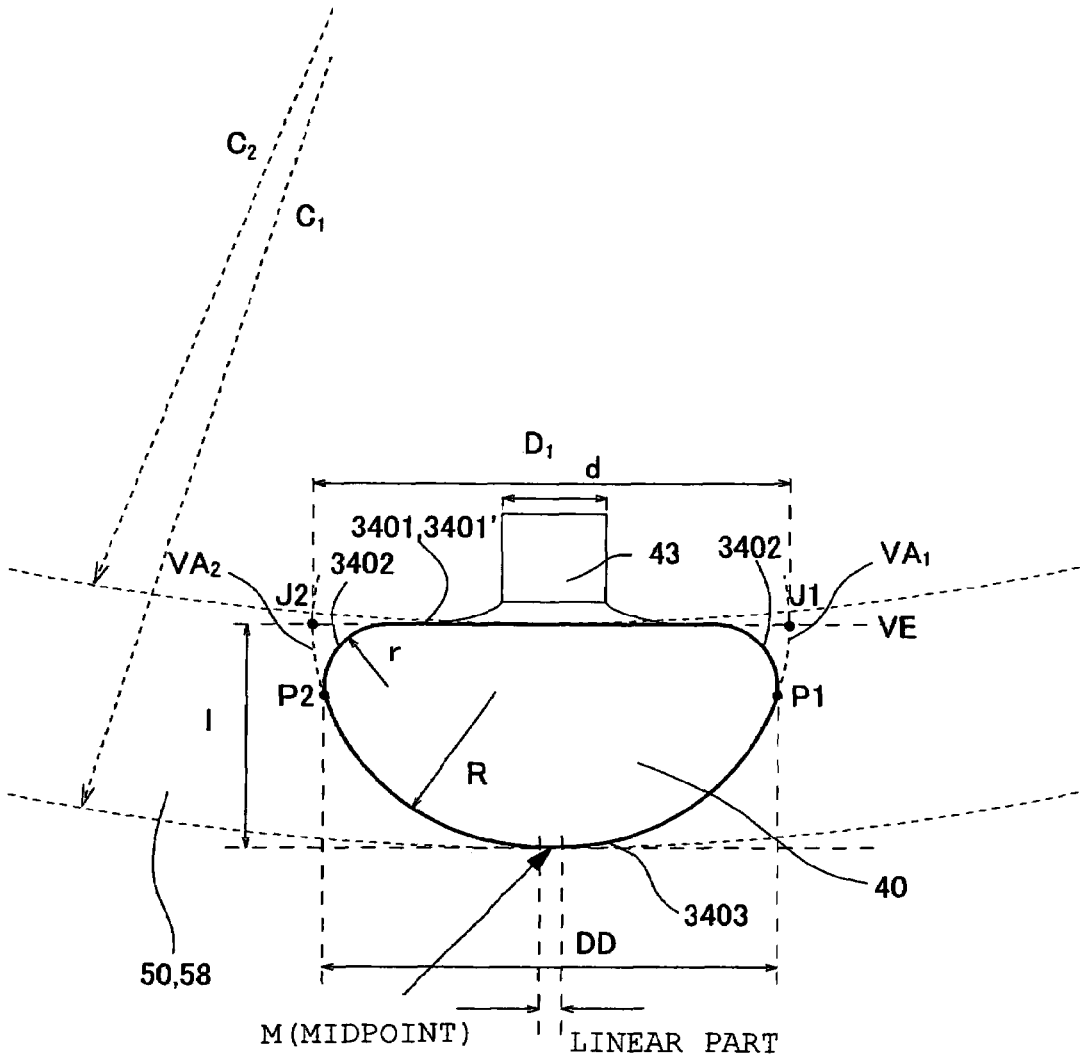
FIG. 7 is a diagram showing a fourth embodiment, as viewed from the another end side in the extending direction of the ground electrode 40.
Figure 8:
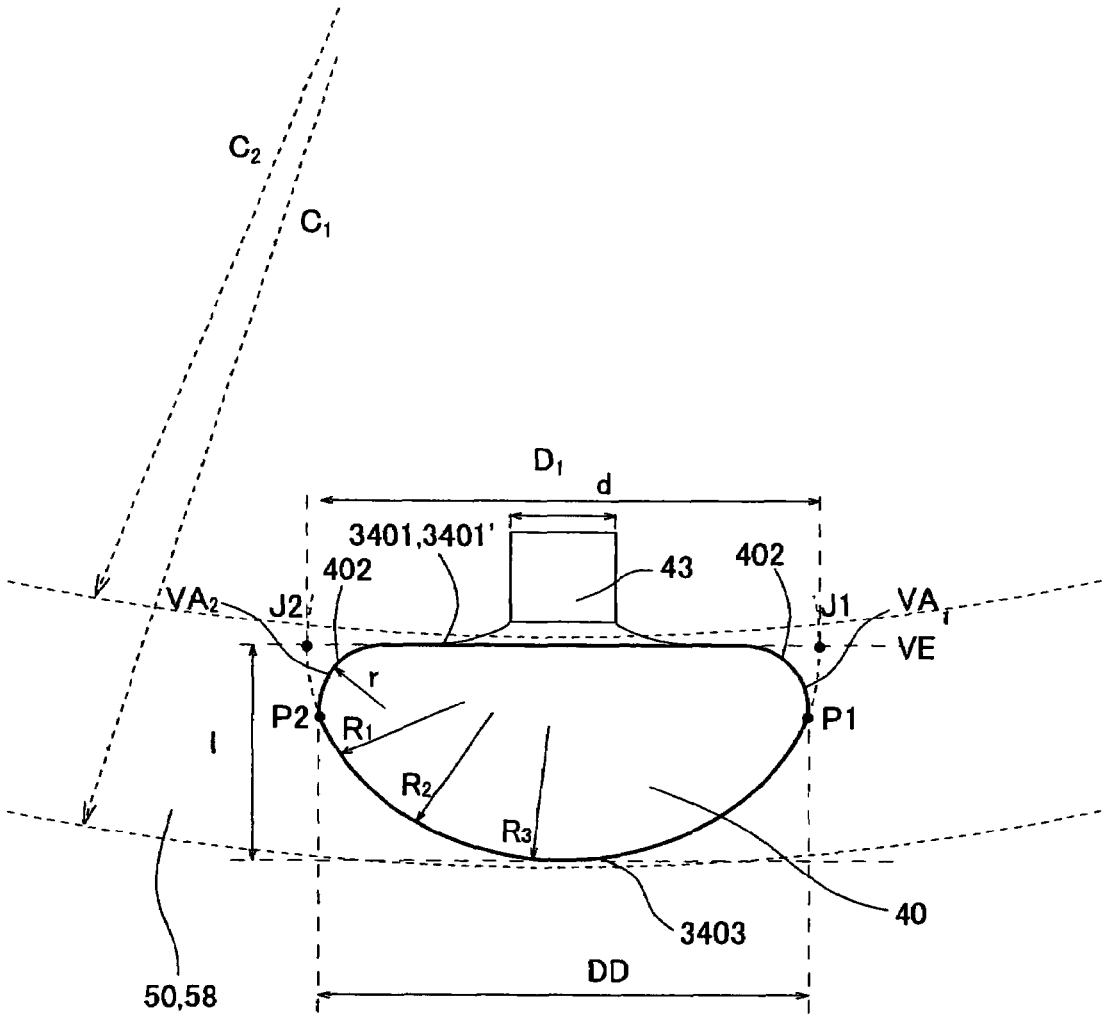
FIG. 8 is a diagram showing a fifth embodiment, as viewed from the another end side in the extending direction of the ground electrode 40.

As shown in FIG. 6, when viewed in the extending direction of the ground electrode 40 (corresponding to the front-and-back direction of the plane of the paper), the outline of the ground electrode is formed by: a flat face 3401 formed as a linear portion 3401' on the side of the center electrode 10 (the upper side of the drawing); and inner arcuate portions 3402 which draw a substantially one-quarter arc on the both ends of the linear portion 3401' having a radius curvature r. Furthermore, an outer arcuate portion 3403 which draws an arc having a radius curvature R (>r) is formed so as to connect the ends of the arcs of the inner arcuate portions 3402 which are on the both sides of the outer arcuate portion. The inner arcuate portions 3402 and the outer arcuate portion 3403 correspond to "first arcuate portions" and "second arcuate portion" in the invention, respectively.

The value which can be taken by the thickness l of the ground electrode 40 in the third embodiment is determined in the same manner as the first embodiment. Therefore, the description of the value is omitted.

Next, the width DD of the ground electrode 40 will be described. The end points P1, P2 of the outer arcuate portion 3403 are extended until intersecting with an extension line VE of the linear portion 3401', thereby drawing virtual arcs VA1, VA2. The intersections are indicated by J1, J2, respectively, and the distance between J1 and J2 is indicated by $D_1$ (hereinafter, referred to as the intersection distance $D_1$). In the embodiment, the intersection distance $D_1$ corresponds to two times the radius curvature of the outer arcuate portion 3403. In further consideration of the production tolerance, the distance can take a value which is slightly larger than 2R. It is a matter of course that margins are set and the distance may be smaller than 2R. The end points P1, P2 correspond to "other ends of said first arcuate portions" in the invention.

The radius curvature r of the inner arcuate portions 3402 will be described.

Figure 12:
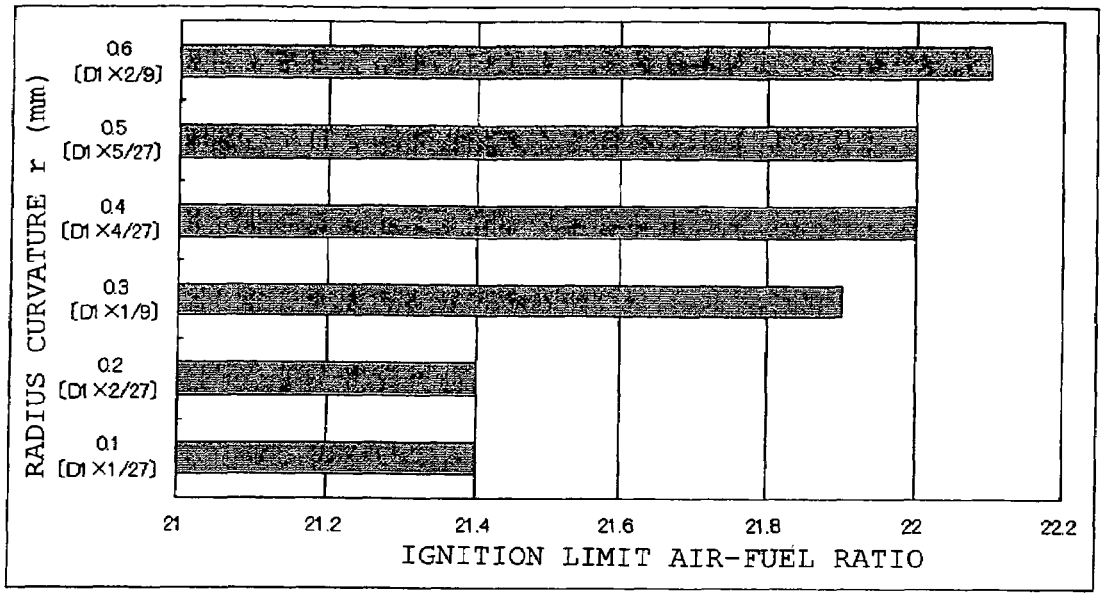
FIG. 12 is a view relating to tests which were conducted in order to determine a radius curvature r.

The radius curvature r can be set with reference to the intersection distance $D_1$. Tests which were conducted in order to determine the radius curvature r will be described. Spark plugs 100 in which the intersection distance $D_1$ is 2.7 mm, and the radius curvature r of the inner arcuate portions 3402 are changed in the step of 0.1 mm were prepared. The ignition limit air-fuel ratio was obtained for each of the spark plugs 100. The ignition limit is determined in the following manner. The air-fuel ratio is gradually increased. When the number of occurrences of misfiring reaches 1% (in 1,000 tests, the number of occurrences of misfiring is ten), it is determined that the ratio reaches the limit. Results are shown in Table 1 and FIG. 12.

TABLE 1

| | r (mm) | | | | | |
|---|---|---|---|---|---|---|
| | 0.1 [$D_1$ × 1/27] | 0.2 [$D_1$ × 2/27] | 0.3 [$D_1$ × 1/9] | 0.4 [$D_1$ × 4/27] | 0.5 [$D_1$ × 5/27] | 0.6 [$D_1$ × 2/9] |
| A/F | 21.4 | 21.4 | 21.9 | 22 | 22 | 22.1 |

From these results, it is confirmed that, when the radius curvature r is 0.3 mm or more, i.e., when the radius curvature is equal to or larger than 1/9 of the intersection distance $D_1$, the ignition limit air-fuel ratio is remarkably improved. When the radius curvature r is smaller than $D_1/9$ (for example, r=0.2 mm), the inner arcuate portions are excessively small, and hence it may cause a phenomenon that a gas flow in a combustion chamber is disturbed at the inflection points (corresponding to the end points P1, P2 in FIG. 6) which are the interfaces between the outer arcuate portion 3403 and the inner arcuate portions 3402. Specifically, the flow of the air-fuel mixture from the outside of the ground electrode 40 is separated from the ground electrode 40 at the inflection points, and fails to efficiently reach the side of the center electrode 10. Consequently, there is fear that the combustion efficiency is impaired. By contrast, when the radius curvature r exceeds $D_1/5$ (for example, r=0.6 mm), the width of the flat face 3401 (i.e., the length of the linear portion 3401') for joining the outer tip 43 cannot be sufficiently obtained. Consequently, there is fear that the joining strength is lowered and the heat dissipation property is impaired. Moreover, the radius curvature R of the outer arcuate portion 3403 is reduced, and hence there is a possibility that the effect of the flame developing property which is equivalent to that in a round ground electrode cannot be attained. Therefore, the radius curvature r is set to be equal to or larger than $D_1/9$ and equal to or smaller than $D_1/5$. As described above, the width DD of the ground electrode 40 is determined in consideration of the balance between the radius curvature r of the inner arcuate portions 3402 and the radius curvature R of the outer arcuate portion 3403.

The outer diameter d of the outer tip 43 is set so as to be equal to or larger than 0.4 mm and equal to or smaller than 0.8 mm, on the basis of the relationships of the durability and the flame developing property. In further consideration of the outer diameter d, the intersection distance $D_1$, the radius curvature r of the inner arcuate portions 3402, and the outer diameter d of the outer tip 43 satisfy a relationship of $D_1-2r \geqq 1.5d$.

The dimension of $D_1-2r$ means the width which can be obtained in the flat face 3401 on the side of the center electrode 10. When the dimension is smaller than 1.5d, there arises a possibility that the joining strength of the outer tip 43 is lowered, thereby causing fear of a trouble such as a dropping off of the tip. Moreover, d means the outer diameter of the columnar noble metal tip. After the spark plug is completed, therefore, it corresponds to the outer diameter of the tip end (on the side of the center electrode 10) of the outer tip 43.

The intersection distance $D_1$, and the thickness l, width DD, and radius curvatures r, R of the ground electrode 40 which are determined as described above have respectively the following values:

$D_1$=2.7 mm,
1=1.3 mm,
DD=2.5 mm,
r=0.4 mm,
R=1.3 mm.

As described above, according to the invention, even in the case where the dimensions cannot be sufficiently ensured, such as the case where the thread diameter of the metal shell is M12 or less, or the thickness of the tip end face of the metal shell is, for example, 1.0 to 1.5 mm, provision of a flame developing property equivalent to that of a round ground electrode, and a prolonged lifetime can be realized.

Various modifications of the third embodiment may be formed. In the third embodiment, for example, the radius curvature R of the outer arcuate portion 3403 is set so that, when the virtual arcs VA1, VA2 are drawn, they intersect with the extension line VE of the linear portion 3401' of the inner flat face 3401 to form a semicircle having a radius of R. Even when the ground electrode 40 is produced under this setting, a small flat face may be possibly formed at the midpoint M (the fourth embodiment, see FIG. 7) of the outer arcuate portion 3403 because a production error occurs. When the flat face is small, however, it can be said that the flat face exerts little influence on the combustion efficiency. Furthermore, the radius curvature R of the outer arcuate portion 3403 may be modified so as to be further increased as more advancing toward the midpoint M. According to the configuration, the width DD of the ground electrode can be made large without lowering the combustion efficiency (the fifth embodiment, see FIG. 8). In this configuration, $D_1$ is allowed to be in the range of about $1.81 \leqq D_1 \leqq 2.51$.

In the embodiment, a core member is not used in the ground electrode 40. When a spark plug is produced while being specialized in improvement of the performance, a well-known Cu core or the like may be used.

Next, the third to fifth embodiments are examined.

Spark plugs 100 in which the intersection distance $D_1$ is 2.7 mm, the thickness l of the ground electrode 40 is 1.3 mm, the width DD of the ground electrode 40 is 2.5 mm, the radius curvature r is 0.4 mm, the radius curvature R is 1.3 mm, the tip diameter d is 0.7 mm, and the gap G is 1.1 mm are prepared. In the spark plugs 100, the gap H between the tip end of the inner tip 13 joined to the center electrode 10 and a portion of the ground electrode 40 which is closest to the center electrode 10 is variously changed so that H−G has relationships listed in Table 2 below.

The produced spark plugs 100 are subjected to a desk spark test in which a spark discharge is produced 100 times under atmospheric pressure of 0.4 MPa. The number of spark discharges in which a discharge occurs not on the outer tip 43 joined to the ground electrode 40 but on the molten portion for joining the outer tip 43 with the base material of the ground electrode 40 is counted. The incidence rate is shown as the occurrence rate of side sparks.

TABLE 2

| | H−G (mm) | | | | | |
|---|---|---|---|---|---|---|
| | 0.1 | 0.2 | 0.3 | 0.4 | 0.5 | 0.6 |
| Occurrence rate of side sparks | 34 | 25 | 12 | 7 | 0 | 0 |

By contrast, spark plugs 100 which were produced in the same manner as described above so that H−G has relationships listed in Table 3 below were subjected to a simulation test which corresponds to a travel distance of 100,000 km in an actual vehicle, and the increase of the gap was checked. A four-cylinder engine having 2,000 cc displacement was used in the test.

TABLE 3

| | H−G (mm) | | | | | | | | |
|---|---|---|---|---|---|---|---|---|---|
| | 0.1 | 0.2 | 0.3 | 0.4 | 0.5 | 0.6 | 0.8 | 1.0 | 1.2 |
| Increase of gap (mm) | 0.11 | 0.12 | 0.14 | 0.13 | 0.16 | 0.16 | 0.17 | 0.18 | 0.21 |

From Table 2 above, the result that, when H−G is 0.5 mm or more, the occurrence rate of side sparks is 0% was obtained. With respect to H−G, therefore, 0.5 mm is set as the lower limit. By contrast, the consumption of the noble metal tip 43 will be considered. When H−G exceeds 1 mm, specifically, when H−G is 1.2 mm, the gap increase exceeds 0.2 mm. In a high-durability spark plug, usually, it is requested that the gap increase after a travel distance of 100,000 km is 0.2 mm or less. With respect to H−G, therefore, 1.0 mm is set as the upper limit.

Next, a sixth embodiment will be described.

Figure 9A:
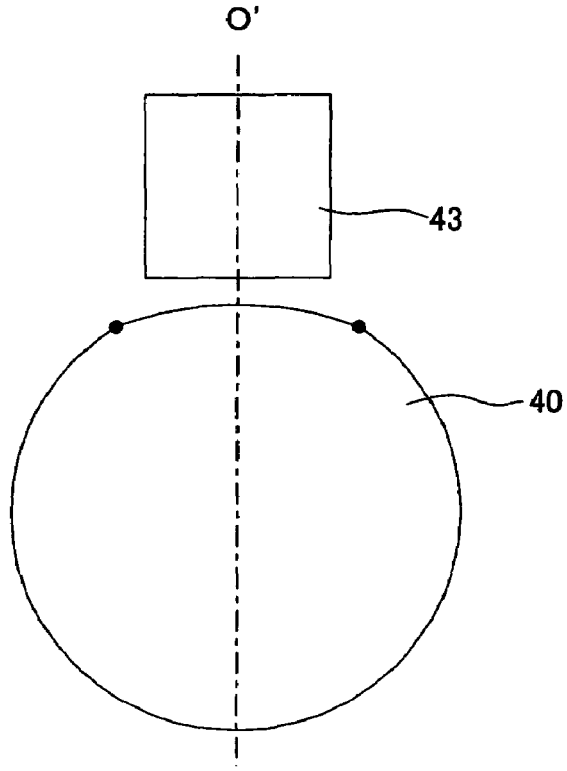
FIGS. 9A and 9B are diagrams showing a sixth embodiment, particularly illustrating a joining manner between the ground electrode 40 and a noble metal tip 43.

As shown in FIG. 9A, the ground electrode 40 has a columnar shape of a substantially true circle, and also the outer tip 43 has a columnar shape of a substantially true circle. As shown in the enlarged view of FIG. 9B, the portion of the ground electrode 40 to which the outer tip 43 is to be joined, and the periphery of the portion are divided into a section A which is slightly wider than the width of the outer tip 43, and which has a larger radius curvature, and a section B which excludes the section A, and which has a smaller radius curvature. The radius curvature of the section B is substantially equal to the radius of the ground electrode 40. For the sake of description, the outline of the ground electrode 40 is shown with exaggeration in FIG. 9B. The state after the joining between the ground electrode 40 and the outer tip 43 is indicated together with the molten portion by broken lines.

Figure 9B:
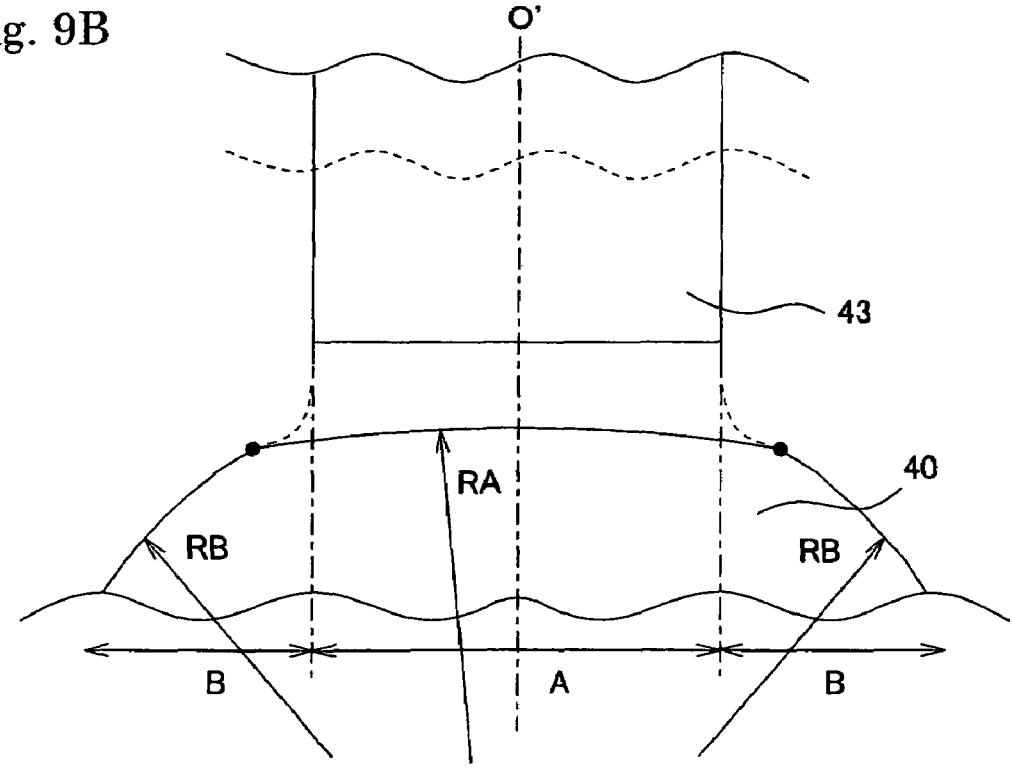

Referring to FIG. 9B, the sections A, B in the invention will be described.

Two straight lines (indicated by long-short dash lines) which divide the section A from the section B, and which are parallel to the axis O' of the outer tip 43 are requested to pass through a portion of the outer tip 43 which is closest to the ground electrode 40, and may perform the division in any manner. In this description, the division lines are coincident with the outer peripheral edge of the outer tip 43. When the radius curvatures RA, RB of the sections A, B which are formed as a result of the division are compared with each other, the relationship of RA>RB is obtained. Therefore, the joining face of the ground electrode 40 with respect to the outer tip 43 can be made substantially flat, and hence more firm joining strength can be obtained.

Next, a step of welding the noble metal tip 43 to the columnar ground electrode 40 will be described.

The welding step is roughly divided into a positioning step of positioning the noble metal tip 43 with respect to the ground electrode 40, and a welding step of joining the positioned noble metal tip 43 to the ground electrode 40.

First, the states of the ground electrode 40 and the noble metal tip 43 in the positioning step will be described.

Figure 10A:
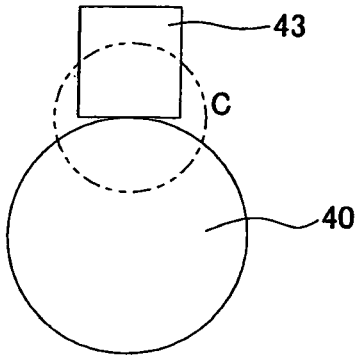
FIGS. 10A, 10B, 10C, 10D and 10E are views illustrating particularly a temporary fixation state in steps of joining the noble metal tip 43 to the ground electrode 40.
Figure 10B:
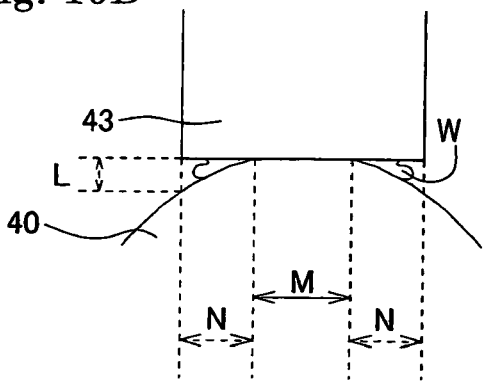

FIG. 10A is a view showing a state immediately before the welding, as viewed from the another end side (front side of the plane of the paper) of the round ground electrode 40 in the extending direction, and FIG. 10B is a enlarged view showing the portion surrounded by the circle C in FIG. 10A, in an exaggerated manner for the sake of description.

The positioning step may be performed by a method in which a state where the noble metal tip 43 butts against the ground electrode 40 but not joined is held by a holding tool (not shown), i.e., means for positioning in a so-called non-joined state, or a method in which the noble metal tip 43 is joined to the ground electrode 40 in a simple manner, i.e., means for positioning in a temporary joined state (temporary fixation). FIG. 10B exemplarily shows a step of performing temporary fixation by resistance welding.

As shown in FIG. 10B, when temporary fixation is conducted by resistance welding, a near-center portion M of the noble metal tip 43 butts against the round ground electrode 40, but the portion N (hereinafter, often referred to as outer circumferential portion N) excluding the near-center portion M is separated from the round ground electrode 40 by a distance L to be in "floating state" (although small, a welding protrusion W exists). The state where the near-center portion M of the noble metal tip 43 contacts with the round ground electrode 40, and the outer circumferential portion N is a noncontact state is an example of "positioning state". Conditions of welding for the temporary fixation may be adequately changed. Depending on the welding conditions, the outer circumferential portion N is not always in a noncontact state.

Figure 10C:
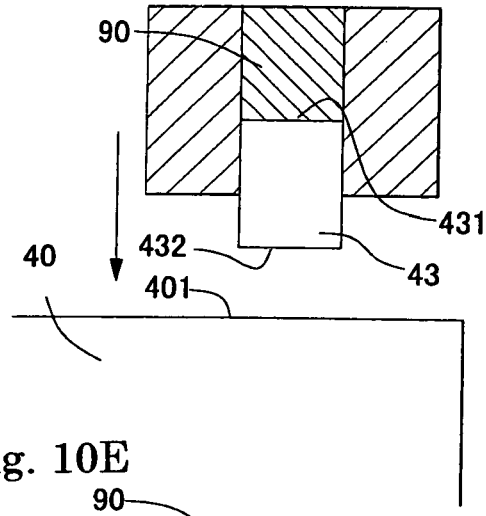
Figure 10D:
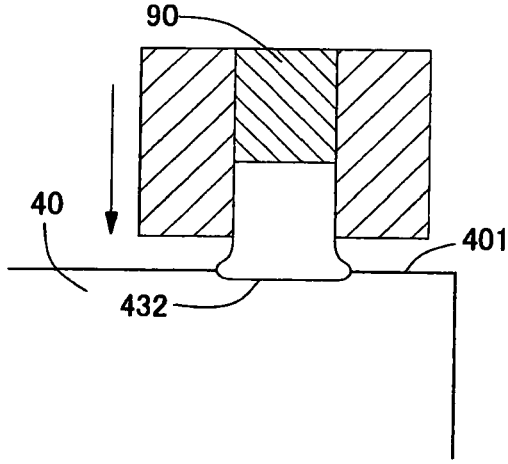
Figure 10E:
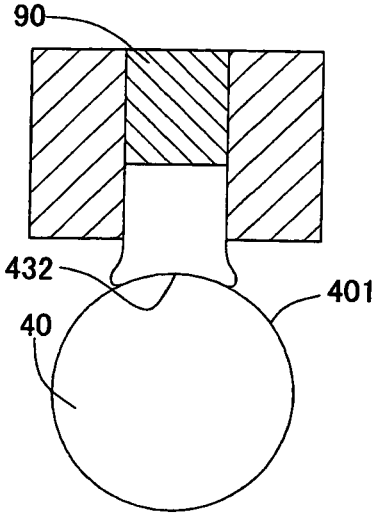

As shown in FIG. 10C, for example, the outer tip 43 which is positioned with respect to the inner face 401 of the ground electrode 40 that faces the center electrode 10 is resistance-welded under the state where the lower face 432 opposite to an opposing face 431 on the side of the center electrode 10 is pressed by an welding electrode 90 against the inner face 401 of the ground electrode 40, thereby performing temporary fixation. During the resistance welding step, the portion of the outer tip 43 excluding the lower face 432 and a lower portion in the periphery of the lower face is held by the welding electrode 90, and the outer tip 43 is pressed against the inner face 401, whereby the portion of the outer tip 43 which is exposed from the welding electrode 90 extends in a flange-like manner (FIGS. 10D and 10E). This is an example in which the outer circumferential portion N is not in a noncontact state. The above corresponds to the positioning step.

Next, the welding step of joining the noble metal tip 43 to the ground electrode 40 will be described.

Figure 11A:
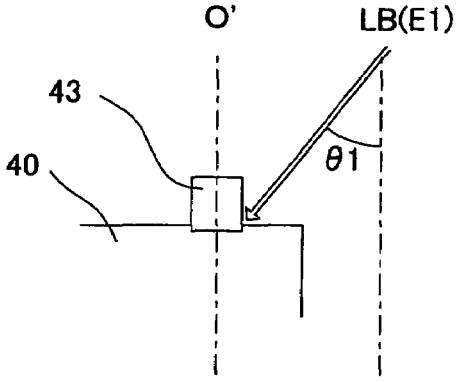
FIGS. 11A, 11B, 11C and 11D is views illustrating particularly a welding step in the steps of joining the noble metal tip 43 to the ground electrode 40.

FIG. 11A is a diagram showing the step of joining the noble metal tip 43 to the round ground electrode 40, as viewed in a direction perpendicular to the extending direction. Since the noble metal tip 43 is temporarily fixed by resistance welding in the positioned state, the lower face 432 of the noble metal tip 43 is slightly lower than the surface 401 of the round ground electrode 40. In this state, irradiation with a laser beam LB is conducted to perform laser welding.

In the diagram of FIG. 11A, a place where the noble metal tip 43 and the round ground electrode 40 are joined to each other by the temporary fixation is set as a start position 0° for laser welding, and irradiation with the laser beam LB begins at the position. At this time, the irradiation angle of the laser beam LB is θ1 with respect to the tip axis O' of the noble metal tip 43.

Figure 11B:
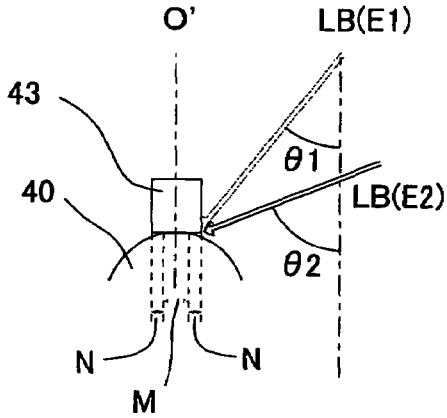

The irradiation with the laser beam LB is sequentially conducted in the circumferential direction of the noble metal tip 43. When the irradiation proceeds by about 90° from the start position 0° of FIG. 11A, the state shown in FIG. 11B is obtained. In the state of FIG. 11B, the irradiation angle of the laser beam LB is θ2. If the irradiation angle remains θ1, there is a possibility that the butting interface between the noble metal tip 43 and the round ground electrode 40 is not irradiated with the laser beam LB because the noble metal tip 43 is sometimes in "floating state". Therefore, the welding cannot be completely conducted, and sufficient strength cannot be obtained. As a countermeasure against this, as shown in FIG. 11B, the irradiation angle θ2 of the laser beam LB is made larger than θ1, thereby enabling the butting interface to be irradiated with the laser beam. Therefore, the noble metal tip 43 can be firmly joined to the round ground electrode 43.

Figure 11C:
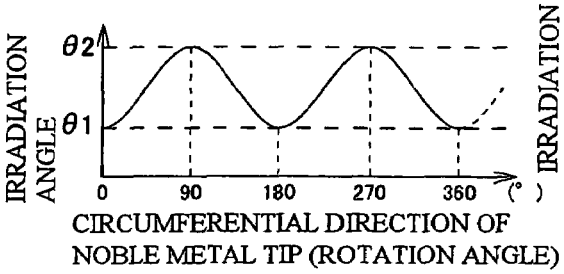

When the laser welding further proceeds by about 90°, i.e., at a position of 180° from the start position 0°, the irradiation angle returns to θ1. At a position where the laser welding further proceeds by about 90° (position of 270° from the start position 0°), the irradiation angle is again set to θ2. FIG. 11C conceptually shows the manner of the change of the irradiation angle of the laser beam LB. When, as described above, the irradiation angle of the laser beam LB is adequately changed in accordance with the temporary fixation state of the noble metal tip 43 with respect to the ground electrode 40, the noble metal tip 43 can be joined more firmly and surely to the round ground electrode 43. The adjustment of the irradiation angle may be performed by inclining the tip axis O', or by a configuration in which the tip axis O' is horizontally moved and the orbit of a portion irradiated with the laser beam LB is oval. Of course, an apparatus (not shown) for irradiation with the laser beam LB may be structured so as to be movable.

Figure 11D:
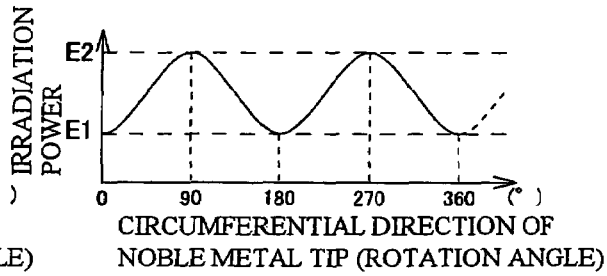

In the above, the welding step has been described. Alternatively, the irradiation angle of the laser beam LB may be fixed, and the irradiation energy of the laser beam LB may be changed depending on the position to be irradiated with the laser beam LB. FIG. 11D shows this concept. In this way, when the noble metal tip 43 is in "floating state" with respect to the ground electrode 40, the power is intensified. Therefore, the molten amount of the noble metal tip 43 is increased, and strength of joining to the ground electrode 40 can be improved.

The irradiation angle θ and the irradiation energy are not always changed in a sinusoidal manner as shown in FIGS. 11C and 11D. For example, in advance of irradiation with the laser beam LB, the positioning state is detected by a CCD camera or the like, and the irradiation angle θ is feedback controlled on the basis of the detected state.

In this configuration, the irradiation angle θ draws a distorted sinusoidal waveform. Of course, the feedback control allows the joining state to become a more accurate state.

The thus produced spark plug 100 is realized as a spark plug in which a noble metal tip is firmly joined to a round ground electrode, and which is excellent in spark wear resistance and has a superior flame developing property.

As the fifth embodiment of the invention, the example in which the radius curvatures RA, RB of the sections A, B have the relationship of RA>RB has been described. As set forth in the appended claims, a configuration in which a relationship of RA=RB is established, or in which the outline of the ground electrode 40 forms a substantially true circle can be employed.

This application is based on Japanese Patent application JP 2005-297046, filed Oct. 11, 2005, Japanese Patent application JP 2005-297047, filed Oct. 11, 2005, and Japanese Patent application JP 2005-297048, filed Oct. 11, 2005, the entire contents of which are hereby incorporated by reference, the same as if set forth at length.

What is claimed is:

1. A spark plug comprising:

a center electrode extending in a direction of an axis of said spark plug;

a cylindrical insulator which has a shaft hole, and which holds said center electrode in said shaft hole in a state where a tip end of said center electrode is projected from a tip end face of said insulator;

a metal shell which holds said insulator; and a ground electrode in which one end is joined to a tip end face of said metal shell, and which extends from said one end toward another end, wherein said ground electrode has an inner side face which faces said center electrode, and an outer side face which is a back face with respect to said inner side face, said outer side face is formed as an arcuately curved face when viewed from a side of said another end in an extending direction of said ground electrode, and a columnar noble metal tip is joined to said inner side face and wherein, when said ground electrode is viewed from the side of said another end in the extending direction of said ground electrode, said ground electrode has:

a flat face which is in said inner side face, and in which an outline of said ground electrode is formed as a linear portion; and two first arcuate portions which begin at end portions of said linear portion, and which are positioned on sides of ends of said linear portion, respectively, and said tip end face of said noble metal tip protrudes more than an intersection of two virtual extended arcs on a side of said inner side face, said virtual extended arcs having a radius curvature R which is equal to radius curvatures of said first arcuate portions, and being formed be by extending said first arcuate portions.

2. The spark plug according to claim 1, wherein a direction in which said noble metal tip protrudes from a portion that is joined to said ground electrode is set as a tip axis, and a protrusion length of said noble metal tip in a direction of the tip axis is larger than a width of said noble metal tip in a direction which is perpendicular to the direction of the tip axis.

3. The spark plug according to claim 1, wherein, when said ground electrode is viewed from the side of said another end in the extending direction of said ground electrode, in one of said two first arcuate portions, a center of an arc forming said one first arcuate portion is on a centerline dividing said linear portion or on a side of another one of said two first arcuate portions with respect to the centerline.

4. The spark plug according to claim 1, wherein, when said ground electrode is viewed from the side of said another end in the extending direction of said ground electrode, said ground electrode has:

a flat face which is in said inner side face, and in which an outline of said ground electrode is formed as a linear portion; and two first arcuate portions which begin at end portions of said linear portion, and which are positioned on sides of ends of said linear portion, respectively, and said flat face is positioned between a midpoint of (h+1) and said tip end face of said noble metal tip, (h+1) being defined by: a protrusion length h by which, when a direction in which said noble metal tip protrudes from a portion that is joined to said ground electrode is set as a tip axis, said noble metal tip protrudes in the direction of the tip axis; and a thickness 1 of said ground electrode in a radial direction of said axis of said spark plug.

5. The spark plug according to claim 1, wherein a spark discharge gap G which is formed by said tip end of said center electrode and said noble metal tip joined to said ground electrode, and a gap H which is a minimum gap between said tip end of said center electrode and said ground electrode satisfy a relationship of $$0.5\ \text{mm} \leqq H-G—1.0\ \text{mm}.$$

6. The spark plug according to claim 1, wherein, when said ground electrode is viewed from the side of said another end in the extending direction of said ground electrode, said ground electrode is formed by:

a flat face which is in said inner side face, and in which an outline of said ground electrode is formed as a linear portion;

two first arcuate portions which have a radius curvature r, and which begin at end portions of said linear portion, which extend toward other ends of said first arcuate portions, and which are positioned on sides of ends of said linear portion; and a second arcuate portion through which said other ends of said first arcuate portions are coupled together, and which has a radius curvature R.

7. The spark plug according to claim 6, wherein the radius curvature r of said first arcuate portions, and the radius curvature R of said second arcuate portion satisfy a relationship of $r<R$.

8. The spark plug according to claim 7, wherein, in said ground electrode, when a distance between two intersections at which a virtual arc formed by extending an outer peripheral edge of said second arcuate portion intersects with a virtual extension line of said linear portion is $D_1$, the radius curvature r of said first arcuate portions is $D_1/9 \leqq r \leqq D_1/5$.

9. The spark plug according to claim 8, wherein an outer diameter d of said noble metal tip is $0.4\ \text{mm} \leqq d \leqq 0.8\ \text{mm}$, and said ground electrode satisfies a relationship of $D_1-2r \geqq 1.5d$.

10. A spark plug comprising:

a center electrode extending in a direction of an axis of said spark plug;

a cylindrical insulator which has a shaft hole, and which holds said center electrode in said shaft hole in a state where a tip end of said center electrode is projected from a tip end face of said insulator;

a metal shell which holds said insulator; and a ground electrode in which one end is joined to a tip end face of said metal shell, and which extends from said one end toward another end, wherein said ground electrode has an inner side face which faces said center electrode, and an outer side face which is a back face with respect to said inner side face, said outer side face is formed as an arcuately curved face when viewed from a side of said another end in an extending direction of said ground electrode, and a columnar noble metal tip is joined to said inner side face wherein, when said ground electrode is viewed from the side of said another end in the extending direction of said ground electrode, said inner side face of said ground electrode is divided by two straight lines which pass through a portion of an outer peripheral face of said noble metal tip, said portion being closest to said ground electrode, and which are parallel to the tip axis, and, when a section of said divided inner side face which is between the two straight lines is set as a section A, and a section of said divided inner side face which excludes said section A is set as a section B, a radius curvature RA of an inner side face in said section A, and a radius curvature RB of an inner side face in said section B satisfy a relationship of RA≧RB.

11. The spark plug according to claim 10, wherein a spark discharge gap G which is formed by said tip end of said center electrode and said noble metal tip joined to said ground electrode, and a gap H which is a minimum gap between said tip end of said center electrode and said ground electrode satisfy a relationship of $$0.5\ \text{mm} \leqq H-G \leqq 1.0\ \text{mm}.$$

* * * * *